US007119270B2

(12) United States Patent
Delaporte

(10) Patent No.: US 7,119,270 B2
(45) Date of Patent: Oct. 10, 2006

(54) GEOMETRIC SYSTEM AND METHOD FOR GENERATING TONE USING FLUID

(76) Inventor: Stephen E. Delaporte, 211 Auburn St., East Williston, NY (US) 11596

( * ) Notice: Subject to any disclaimer, the term of this patent is extended or adjusted under 35 U.S.C. 154(b) by 0 days.

(21) Appl. No.: 11/192,195

(22) Filed: Jul. 28, 2005

(65) Prior Publication Data

US 2006/0021496 A1 Feb. 2, 2006

Related U.S. Application Data

(60) Provisional application No. 60/591,673, filed on Jul. 28, 2004.

(51) Int. Cl.
*G10H 1/32* (2006.01)
*G10H 3/12* (2006.01)

(52) U.S. Cl. ..... 84/745; 84/423 R

(58) Field of Classification Search ..... 84/743, 84/745, 483.2, 427, 423 R
See application file for complete search history.

(56) References Cited

U.S. PATENT DOCUMENTS 3,828,643 A * 8/1974 Morez ..... 84/115
3,941,023 A * 3/1976 Thomas et al. ..... 84/715
4,892,023 A * 1/1990 Takeuchi et al. ..... 84/687
5,415,071 A * 5/1995 Davies ..... 84/471 SR
5,708,461 A 1/1998 Kent
6,580,421 B1 6/2003 Leman
6,680,731 B1 1/2004 Gerpheide
6,911,901 B1 6/2005 Bown
2003/0079920 A1 5/2003 Rantet

* cited by examiner

*Primary Examiner*—Jeffrey W Donels

(57) ABSTRACT

A polyphonic instrument comprises a geometric system coupled with a user interface and a method for generating tone using fluid. The geometric system is arranged such that each point corresponds to a mechanism underlying a malleable surface and is sequentially based upon the 12 tone system of music. The instrument also provides a new method for generating tone by the means of using fluid, whereby a specific frequency is picked up by a separate hydrophone or fluid based transducer submerged in a sealed and removable fluid containment unit having a rotational element also contained within for each note indicated. The rotational element when arranged in a series of graduated units and/or in combination with graduated sub-containment units of fluid changing in scale for separate frequencies, will generate separate tones which may be manipulated through physical and/or analog/digital electronic means.

17 Claims, 26 Drawing Sheets

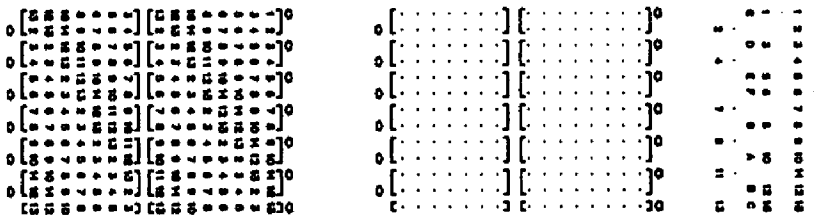
FIG.48
FIG.49
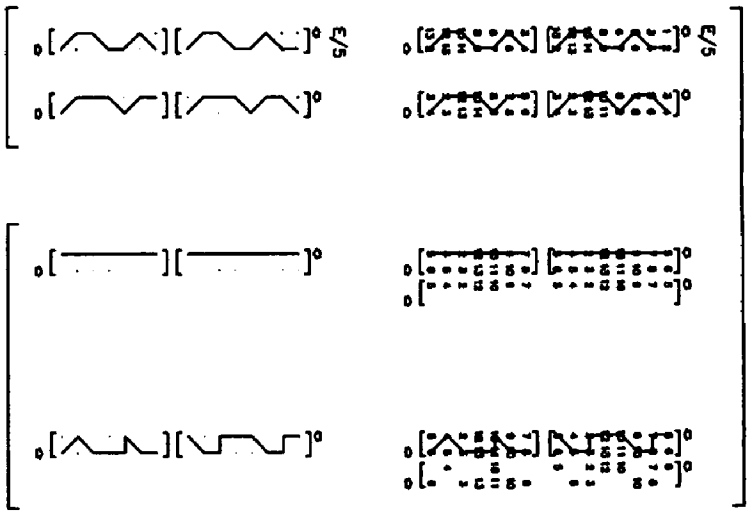
FIG.50
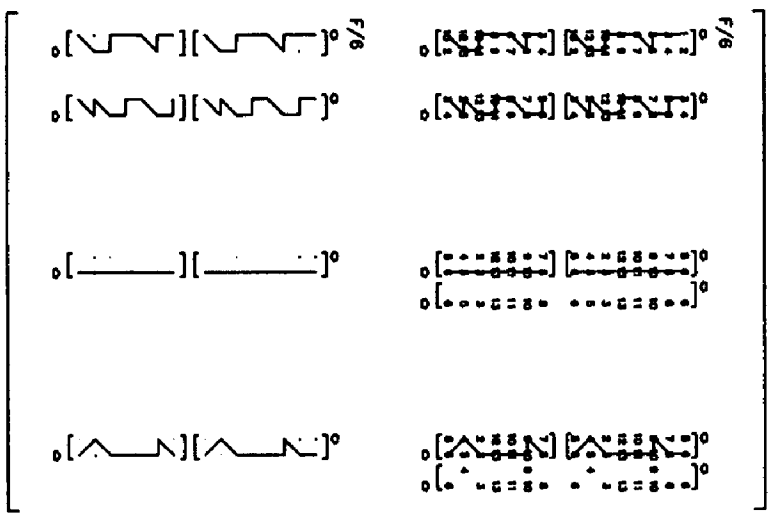
FIG.51

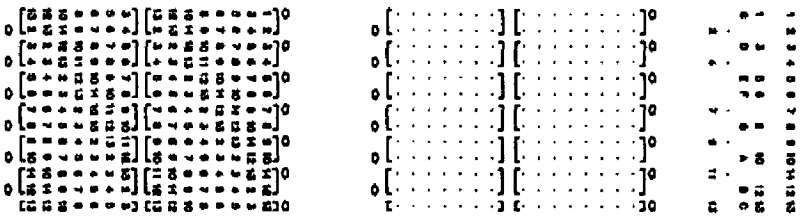
FIG.72
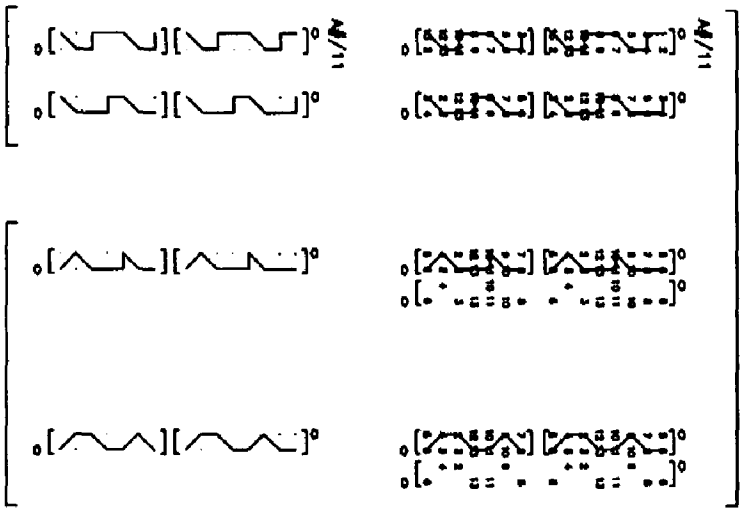
FIG.73
FIG.74
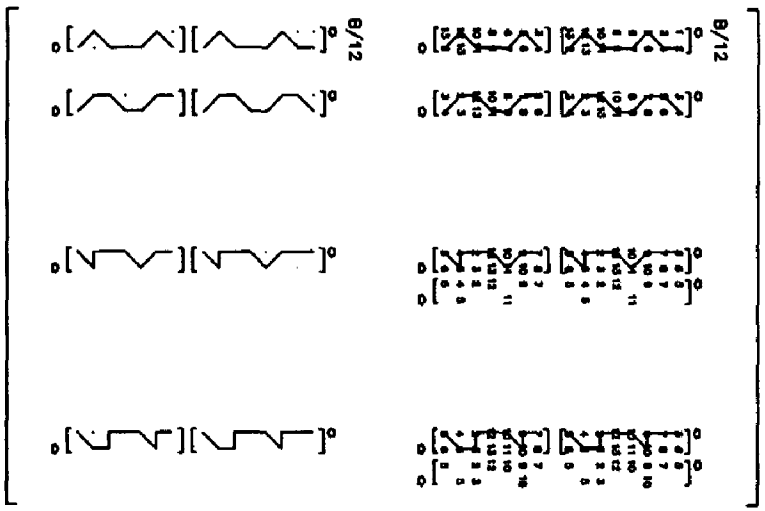
FIG.75

GEOMETRIC SYSTEM AND METHOD FOR GENERATING TONE USING FLUID

CROSS-REFERENCE TO RELATED APPLICATIONS

This application claims the benefit of the filing date of provisional application No. 60/591,673, filed Jul. 28, 2004.

BACKGROUND OF THE INVENTION

The present invention relates to tone generation methods, polyphonic and monophonic instruments, and instrument interfaces that a user or a musician may interact with for the purpose of creating an array of different sounds.

The technique of a touch sensitive based surface as a user interface, has been developed for many different applications, including musical instruments and other pragmatic means. This technique was developed by such scientists as Hugh Le Caine, who also created the first voltage controlled synthesizer which was a monophonic performance instrument. More specifically in relation to a touch sensitive based instrument however, was Hugh Le Caine's invention of the "Printed Circuit Keyboard." This particular invention, which was completed in 1962, was operated by the conductivity of a musician's finger using conductive material evaporated onto an insulator backed sheet. A small current was translated from the musician's finger from one conductive section to another, to complete the circuit. Although this was a brilliant and inventive step towards the evolution of many of it's applications, including a tone generation based instrument, this particular system, governed initially by electronic means, was still limited to a single indication of essentially turning the note on or off with a limited frequency range. This also meant that the availability of changing the dynamics or the intensity of the sound by the musician was not an option.

At present, such familiar methods that are prominently employed are capacitance and resistance based touch pads or surfaces which again, when utilized in the context of a musical instrument, may often present the limitation of at most switching the tone on or off. Other touch sensitive based musical instruments in the past and present have continually been limited for similar reasons including the constant reliability to the traditional piano keyboard arrangement.

Instruments that do retain a conventional user interface and/or arrangements based upon the 12 tone system of music, such as stringed instruments, or chordophones and wind instruments, or aerophones, commonly hold a limiting factor to the number of notes that one may produce. This is apparent when a limited number of strings or valves are available to the user. In addition to this restrictive factor, the length of strings, or in the case of aerophones, the given length of air columns that have been established creates another limitation to the accessibility of a much broader range of frequencies within each given instrument. When these acoustical methods for generating variations in pitch are coupled with an analog and/or digital electronic means for the output of sound, pitch shifting can often be a plausible solution to extending these parameters. However the essential interface that corresponds to the physically generated sounds is still condensed to the specific range that the given instrument is fundamentally capable of providing, which again may present a small range of tones and pitches. These systems, which an instrument and its relative pitches relate to, ultimately have a number of limitations that inhibit one from creating a multiplicity of acoustical features, pitches, tones, and overall sound without the use of otherwise fundamentally creating sounds through digital means. This is especially dominant among monophonic instruments that rely on digital filters for the initial manipulation in creating a variety of tonal features.

A primary difficulty with certain interfaces such as instrument keyboards, is that particular acoustic qualities can not be realized in accordance with a key. These qualities include tones created by such instruments as the violin, whereby a violin can provide a musician with the ability to sustain a note while changing its dynamic. A violin can also provide the user with such qualities as the effect of vibrato. A mechanical based instrument such as the piano, where one may create a specific staccato effect through the mechanics of a key, however can be improved upon by combining the attributes of both kinds of interfaces.

Furthermore, the maximization of notes or keys available to the user within an interface autonomous from the sound generation element is often restrained in the case of smaller sized instruments. In this instance, the arrangement of spacing is simply not condensed in an efficient way restricting the number of notes or keys that a user may access. This can also confine one from creating certain kinds of musical qualities and complexities in the overall composition of sound design that one may prefer to achieve.

The method of creating polyphonic sounds by using the means of fluid or water for tone generation, is also at present, a rarely utilized technique, when it is in fact just another method for creating physical sound that holds versatility that may compare with the possible range of sounds created by a string, wind, percussive or even digitally sound generating instruments.

The use of a "Tone Wheel" is another technique for providing sound that is not often presently employed as well. This idea was pioneered by Thaddeus Cahill, who used the principle within his invention of the "Dynamophone" or "Telbarmonium." The invention of this instrument preceded another invention named the "Hammond Organ" "Hammond Organ," which also used the concept of the tone wheel and was patented approximately 37 years after the "Dynamophone" in 1934. The "Hammond Organ," which was invented by Laurens Hammond, also uses the same principle of having a multiplicity of tone wheels to create separate pitches. In this instance, each tone wheel is made up of a different number of teeth, to ultimately create a change in the magnetic field and the voltage of each rotating tone wheel's respective magnetic pickup. This creates a variation in the frequency given off by each and every given tone wheel within a set. Although this method results in an efficient and prominent system for creating a variation in frequency, the realization of an oscillating or rotating element coupled with a transducer of some form, has rarely ever included the addition of a third factor, such as the element of friction or the density and the state of the fluid surrounding its particular configuration.

Moreover, although the concept of using the physical state of water, or more generally, the concept of utilizing fluid in its liquid state coupled with fluid in its gaseous state is also not commonly employed as a means for tone generation. Such methods have however, been realized in the past, including within such instruments as a water driven tone generating organ dating back hundreds of years. The methods for combining water or fluid with new techniques, or previously existing tone generation methods, such as the tone wheel, is also rarely utilized for musical purposes, which again, can in fact provide a very broad range of acoustical, tone and pitch generation qualities.

SUMMARY OF THE INVENTION

The present invention is a polyphonic instrument that includes a geometric system which is derived specifically from the 12 tone or "Tempered" system of music, whereby each node or point across a two dimensional plane indicates a particular note within the 12 tone system. By arranging this system within an array of 195 points across two separate grids each consisting of 13 columns of points running vertically, or across, the Y-Axis, and two sets of X-Axis coordinates running horizontally separated into a set of 8 rows of points above and 7 rows of points below, the maximization of 104–195 notes may be played over a relatively small surface. It is an object of this invention to utilize this geometric system in an ergonomically efficient way, whereby the performer is able to indicate with all of ten fingers to any combination of notes at any quantity accessible by the interface. This being consistent with the general and basic specification above, an arrangement of points referencing the 12 given tones in an octave being the notes, C, C#, D, D#, E, F, F#, G, G#, A, A#, B and its resolution of the octave being C, or the $13^{th}$ note in this case, is the primary source for the geometric system generated. Ultimately a particular kind of combination and accessibility to activating many notes in new kinds of combinations are provided, due to the arrangement of this particular type of geometric system.

The geometry is arranged such that the complexities in a musical composition or any sound based design may be achieved from the availability of producing tones which overlap or have polyphonic qualities. From this geometric system, ultimately defining scales, a certain kind of character may arise due to its particular arrangement of notes and in combination with its underlying polyphonic character. This geometric system may also bring about a number novel kinds of complexities in the composition of sounds that a musician or user may achieve from the simplest of interaction to the most virtuoso of users. The interface that one might find on a stringed instrument and its corresponding scales will not end like it does on a keyboard. Each mode derived from a scale on a guitar, for example, has a starting point and an ending point that may not be symmetrical to the rigid fret arrangement and grid of strings that is defined. This is all dependent upon what the specific interval is for each given instrument. This being noted along with the present invention, its polyphonic qualities do not conform to these set of parameters because the system is fixed like the mechanical arrangement of certain keyboard based instruments. For example, on a cello the order of strings is different than on a concert bass because the interface is directly linked to the variation in pitch that one may sound. Again, this separation from the physical interface and its physically generated sound presents an advantage to other instruments in this respect as well.

This particular system provides an advantage to using other touch based surfaces in that a range of possibilities may be utilized such as the range of dynamics that may be created and the duration and sustainability of a note. This combination of mechanical switches with analog electronic attachments underlying said geometric system and malleable surface directly indicates a particular output of each tone having a specific dynamic and the ability to combine the qualities of other musical instruments. These qualities include tones created by such instruments as the violin (where a violin can provide a musician with the ability to sustain a note while changing its dynamic) or the qualities of a mechanical based instrument such as the piano (where one may create a specific staccato effect through the mechanics of a key). The effect that one might achieve with "vibrato" on a stringed instrument for example, can also be attained with this instrument because it allows one to achieve the percussive qualities of a piano along with the physical vibration of the surface segment/note where a stringed instrument would give the user access to a similar interface.

The advantage to this touch based surface over the prototypical touch based surface, which usually utilizes capacitance or resistance means, is that it is fundamentally different because of its use of malleability with underlying mechanics directly attached to analog electronic switches. This indicates a more physical interaction with the given surface where a musician has the ability to change the dynamic of the note at that particular point on the surface through pressure and movement. This may be particularly gratifying to the musician when the malleable surface is a veneer wood that is reinforced or backed with paper cardboard. In this case, which may be a common surface manufactured with the entire unit, one may take advantage of the subtle malleability of this particular kind of wood surface where each point would be spaced half an inch in both the y and x axis to create the most efficient configuration where the bending over one point, or the distance indicated through the z-axis, would not interfere with the next note or set of spring driven racks engaged with each switch set. This is the case when the given set of switches is supported with a switch hub that is directly tangent to the given space on the surface next to the point indicating the note. So essentially with the right underlying support there is no interference between the juxtaposition of each and every other note. In combination with the spring driven racks, "flex sensors" may also be employed for a similar result.

It is an object of this invention to provide a tone generation method which employs the concept of a "Tone Wheel" or a rotational element which creates sound either by creating vibration or friction against a secondary object submerged in water or fluid, or directly creating friction with water or fluid contained in combination with a tone wheel or rotational element. A secondary interface is provided as well for physically interacting with the tone wheel through the means of a series of struts. These struts are arranged such that the user may mechanically manipulate them within the internal fluid/rotational element from an external point From the edge of the instrument where one is holding the side with their thumb pressed against the back and all other fingers moving along the front surface for initial tone activation, one may depress these struts in and along separate axes for altering the tone being generated within which may lie against another malleable surface or may be extruded externally from the instrument. This method thus provides a large range of possible tones, pitches and sounds that may be created for musical purposes and more specifically for polyphonic tone generation within a single instrument.

BRIEF DESCRIPTION OF THE DRAWINGS

FIGS. 32–79 show a series of diagrams of the scale geometries with continuous references to the initial array of one hundred and ninety five points, which corresponds directly with the mechanical spring driven switches to be discussed more particularly through the following detailed description. Furthermore, the scales and their respective geometric paths that one would continue along vertically with ones fingers, are shown for the scales in the key of: C, C#, D, D#, E, F, F#, G, G#, A, A# and B which are further described through a continuous sequence and then shown with their complete sets.

DETAILED DESCRIPTION

Figure 1:
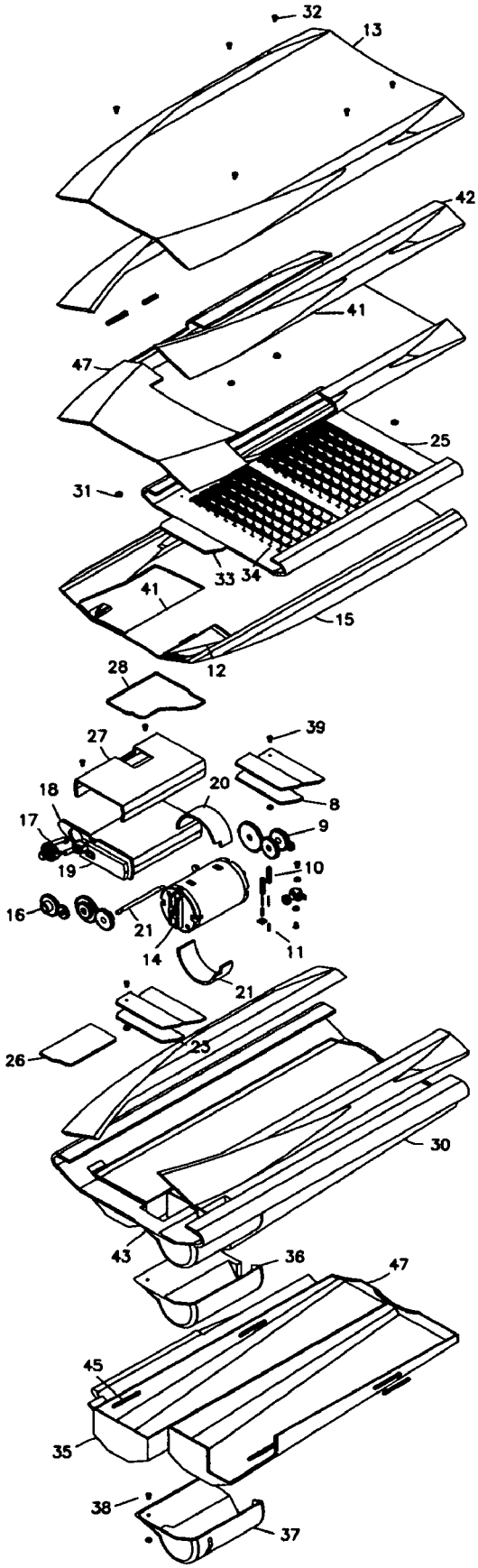
FIG. 1 is an exploded isometric drawing of a significant number of parts from the invention.

In the embodiment present in FIG. 1, a majority of the parts are illustrated for the present invention. Referring to the malleable surface 13 at the top of the drawing, the initial shape, which has a specific set of dimensions and physical curvilinear geometry 42 may vary with a small tolerance. This particular specification is determined by ergonomics and may be represented by different materials depending on the preference of the user. When adjusted to the shape illustrated, whereby the exterior dimensions (being 8.5"× 15"×2.5") are generated by the position and how the instrument rests in relation to the average human body proportions, the distance fifteen inches, determining the entire y-axis, directly references the average proportion between the point just below the shoulders and the point just above the torso, where the back of the instrument 30 may lie tangent to the chest and stomach. The distance eight and a half inches, determining the entire x-axis, references the average distance between the optimal and most comfortable width between each of two hands which may be utilized with said exterior dimension two and a half inches, whereby the distance between the thumb and every other finger may conform and grasp the edge of the curvilinear geometry 42 on both sides of the surface. These dimensions also refer to the most efficient configuration and general rotational length of each of two arms hinging in movement vertically. These ergonomically driven specifications will be discussed further and more graphically in a later figure. The actual thickness of the pliable surface 13 is thin enough so that it may bend inward or along the z-axis to be depressed tangent to the underlying given set of switches 10 and 11 for each point on said surface 13, without losing its rigidity through cracking or ripping while still retaining a certain amount of longevity. This material, of course over time, will be replaceable for it is bound to break. By that detail, the attachment configuration with machine screws 32 from the base of the surface 13 to the shell base 41, or the bottom of the apparatus 43, are indicated at a particular interval so that this surface may be utilized most pragmatically on both a playable and replaceable level. The two most common types of materials that may be utilized to meet these practical specifications are a number of different types of veneer woods including pine with a reinforced backing of paper cardboard to insure a certain amount of malleability, but also a certain amount of rigidity as well. The other type of surface that may be utilized, again depending on the preference of the user, is a transparent vinyl. This particular material would be used to compliment all of each of the shell structures with the apparatus having materials such as transparent acrylic and transparent polycarbonate. The veneer surface would be best complimented with the continuing material of wood for the exterior surfaces 43 and the tone generator exterior fluid containment unit 35.

Now referring to the set of spring driven mechanical switches with analog electronic switch attachments 10 and 11, it is important to note that each of these set of switches represents one point tangent to and below the surface 13 but above and attached to the switch holding unit 25. A more specific explanation of how these spring driven switches indicating each point with its corresponding pitch and how it is utilized, will be discussed more particularly with a more detailed drawing. What may be discussed now in this present FIG. 1, is that each of these switch's specific electronic output and input is directly attached to a printed circuit board arrangement 34 which flows above and below said switch-holding unit 25 with its underlying structure 15. As the PCB 28 lies above and below 41, it also does so at its connection point 33 where it is plugged into its mother connection 8 with its corresponding hardware 39 for proper placement within the entire apparatus engaging it directly inline with the summing amplifier. This summing amplifier is also arranged on a PCB which lies on the motherboard 28 along with the hierarchy of tone and volume control and its placement within part of the supporting structure 47 through a set of potentiometers for the entire unit. The reason for the specific engagement between connection points 33 and 8, is because said switch holding unit 25 may slide in and out of the entire instrument for maintenance or even for a variation on the specifications of the entire arrangement and array of the given points and switches.

Along with these motherboard features also exist the connection of all 195 (max. number) of the hydrophone based transducers which may only be toggled on and off by the analog switches 10 and 11 set for each pitch indicated. It is important to note that these hydrophone or fluid based transducers may vary, but it is most pragmatic to utilize hydrophone piezo-ceramic based benders or transducers. It is also important to note that a plurality of these many separate pitches or tones may be driven through a power amplifier by means of running each separately tuned transducer to a summing amplifier. These transducers, because of the compact nature of the design, are tuned very specifically to the given sub-containment unit of water and rotational element within 94 being held in the sealed and removable fluid containment unit 93 both seen in FIG. 7, with a very small tolerance. Through the means of a digital interface or digital card 26 shown in FIG. 1, which can be reloaded into the corresponding mother connection 23 depending on the desired effect, a manipulation of the final output after the said summing amplifier but before the final output of sound from the power amplifier, may create a completely different set of tones derived initially from the original physical tone.

A primary source to the generation of tones produced by the invention's particular tone generation system includes, two rotational output shafts which are both driven by a single servo motor 14. Referring again now to FIG. 7, which depicts the two sets of sealed and removable water containment units 147 from a single servo motor 143, 141 and 145, two details must be further specified. The first of these two is that a proper gear train 113, 115 and 137, which must be configured with specific gear ratios to produce the proper RPM and torque in combination with the servo motor's specifications to support the exact frequency range from the first single output shaft 119 and 158 to match the same RPM for the second output shaft 111. This is essential so that all tone wheels 123 independent of the number, must all have a fixed speed for each of the changing scale of tone wheels 131 which can further be fixed at the proper interval consistent with the pitches given off. In FIG. 1 a secondary gear train 16 and a primary gear train 9 must also be specified with the proper gear ratios to produce the proper RPM and torque for the exact specification of frequencies given off from the secondary output shaft 111 shown in FIG. 7, which again has the same speed. This combination of idler gears and driving gears must be connected by an inner middle shaft 21 which is directly a result of the offset of the first shaft from the second shaft. Again the pragmatic reason for the use of two output shafts instead of just one, is to create the maximum number of possible frequencies in a compact unit within the entirety of the given apparatus.

The final details to be specified in FIG. 1 include the switch and the jack 17 which may be simply connected to a power amplifier by means of a patch chord. The standard toggle on/off switch with its support 18 will turn the entire instrument on through connecting the current from the AC to DC adapter/power supply 19, with its supporting unit 27 conforming to the exterior shape of the adapter and set of proper machine screws for the most efficient placement within the instrument's supporting elements 41 and 33, to the mother board and all other distribution of proper current and voltage to each electronically driven part. It is also an object of this figure to illustrate the noise reduction system which for the servo motor 14 shown to be held in place from a noise dampener above 20 and a noise dampener below 21 creating a separation between the motor and its corresponding shell 37. This will reduce a certain percentage of the potential vibration noise given off and more particularly when exactly tangent to its conforming holding unit 30. These dampeners in combination with an inner middle supporting unit 36, through electronic means, this noise may be reduced further by canceling out the output frequency of the motor by inverting the sine wave given off. Along with the noise reduction system being an essential part of creating the optimal sound from the tone generator, it is also reducing the noise given off by the gear train with a similar method utilizing noise cancellation through electronics but also to submerge these gears in a particular fluid within a gear box which will ultimately reduce any noise created even further.

Figure 2:
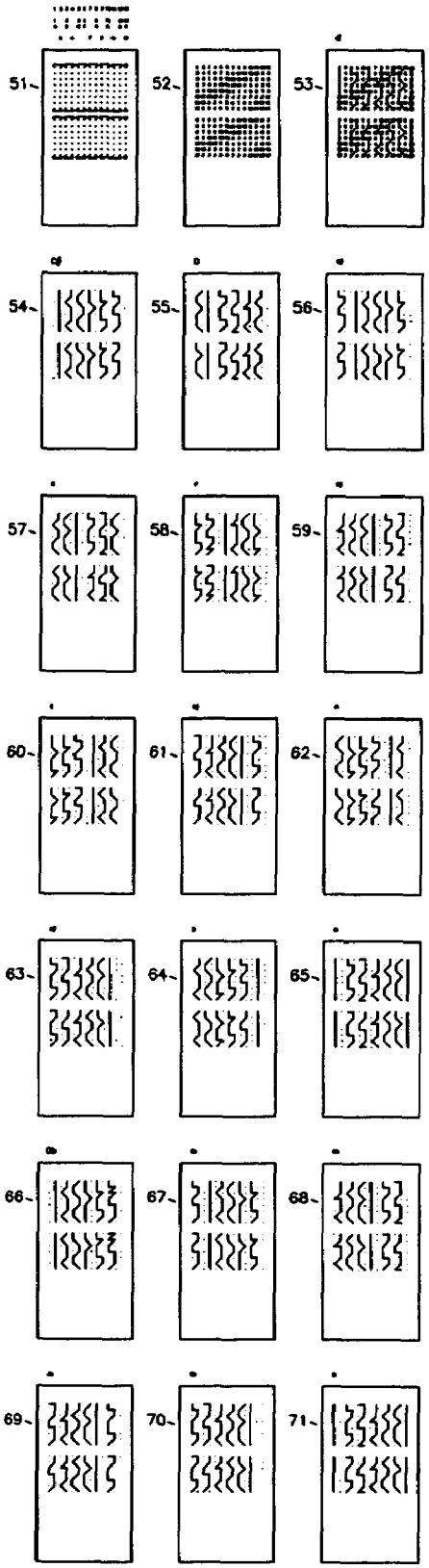
FIG. 2 is a series of plan views which illustrate the auto-generative geometry consisting of each of the twelve fundamental scales with each note hereinafter corresponding to a number, first showing the twelve tones with sharps, then below showing each scale beginning with a flat.
Figure 4:
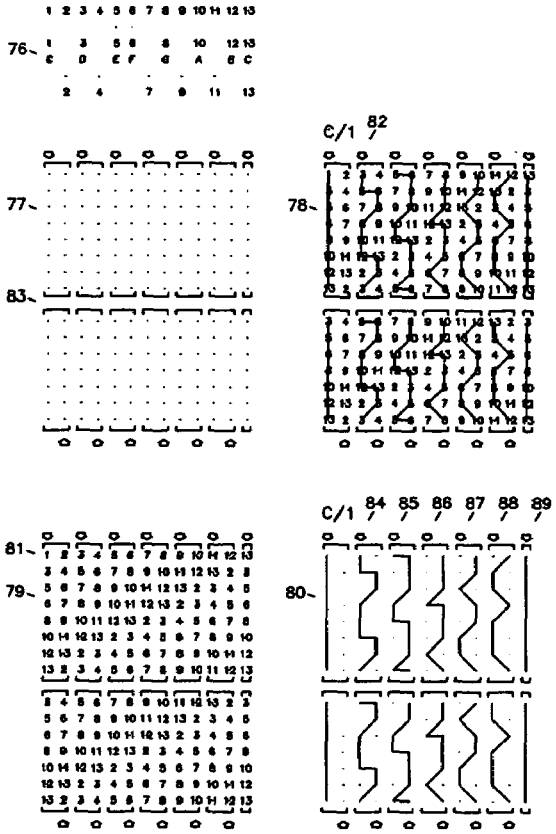
FIG. 4 shows a specific description of these geometric sets and how they are generated from a musical scale.
Figure 77:
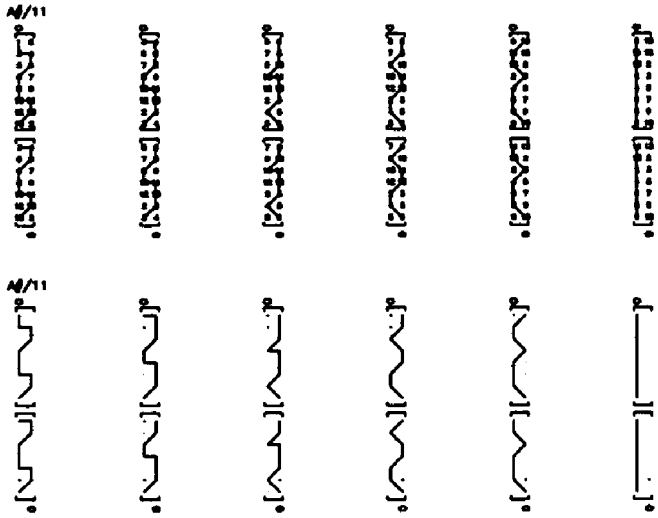
Figure 79:
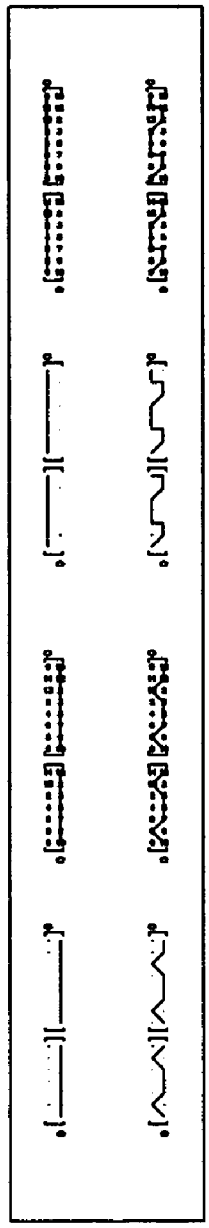

Referring now to FIG. 2 the present set of geometries, represented by points and lines determining each major scale, is auto-generative in that the geometry is derived from a certain given array of points 51 and 52 with an enlargement shown in FIGS. 4, 77 and 79. This is determined through the twelve tone system of music whereby these given tones are represented through a numbering system instead of directly indicating them as notes because of the ambiguity of a note represented by a sharp opposed to a flat or a flat opposed to a sharp, when in fact they may be represented as a single notation or number. A key 76, seen in FIG. 4 defines which notes correspond to what numbers. This may be simply explained by understanding that the progression of the twelve tone scale can be represented by a consecutive set of corresponding numbers one to twelve. These numbers would of course directly correspond in sequence to the notes C, C#/Db, D, D#/Eb, E, F, F#/Gb, G, G#/Ab, and B. In this case the key 76 determining this system, utilizes the number thirteen to represent the octave, in this instance being the note C. Below, in the array of points 77 and then the array of points with numbers 79, a particular arrangement is determined firstly and primarily by the most efficient distance, being a half an inch in both the x and y axis between each point, confined within the previously discussed original set of dimensions also established by ergonomics. Now in order to invent the most logical configuration of points within a compact surface and grid, it is most pragmatic to start with the first row 81 where the first thirteen points or notes across, are arranged representing a chromatic scale starting with "C" or "1". Although the notes across this row may represent a chromatic scale beginning with C, it is important to indicate that they are not represented through the thirteen consecutive tones. These thirteen consecutive tones are instead represented in the y-axis running vertically 81, which is sectioned off by the two present columns. When the first column 81 is arranged with the intervals of a major scale, in this instance being the fundamental scale C, the proper intervals in tone of half steps and whole steps are arranged through the numbers shown in the key 76 and also in this first column 81, which are indicated by the numbers one, three, five, six, eight, ten, twelve and thirteen respectively. There is a break in this column and the continuing columns creating two separate grids (being 13×8 and 13×7) 83 to simply indicate the separation between octaves running vertically. Again it is important to note that for the optimal ergonomic and geometric efficiency these points or notes run vertically simply because of the comfortable movement of each of two hands from two sides of the instrument hinging at the pivot point of the elbow moving vertically. In the set of two columns 84–89, it is apparent how these separate geometric paths indicate the same major scale which simply change with each increasing octave. The geometry changes in correspondence with the changing arrangement of points.

Now referring back to FIG. 2, and continuing with the specification in paragraph above, any major scale may be played which is illustrated from C major increasing chromatically through each major scale to be resolved with C major 53–65, The flat scales which are essentially the same as the corresponding sharp scales 66–70 are then resolved again with the C major scale 71.

Figure 3:
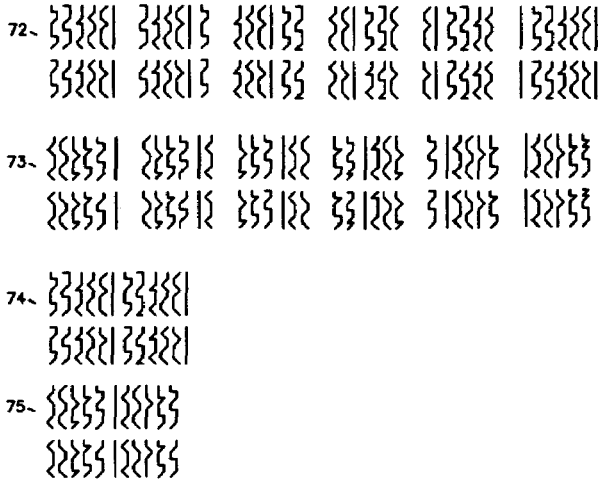
FIG. 3 is a series of plan views showing the representation of these geometries as they exist in two separate sets.

In FIG. 3 one may see the entirety of these auto-generative geometric paths for each set of scales which can simply be divided into two sets indicated first by the odd numbers from the first row 72 and then by the even numbers in the first row 73. When these geometric paths are combined it becomes convenient for the musician in learning these two sets of geometric paths, for each major scale is simply broken down into a repeating sequence 74 and 75.

Figure 8:
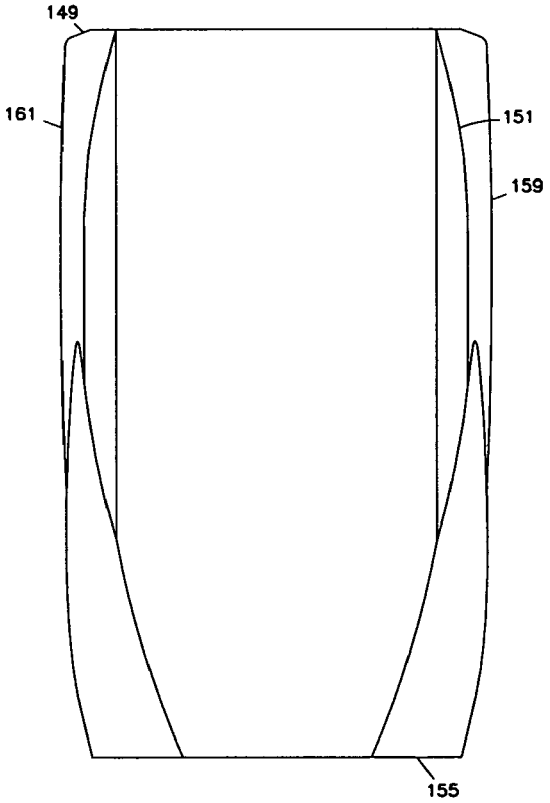
FIG. 8 is a top plan view of the instruments surface which corresponds to its underlying tone wheel set above in FIG. 7.
Figure 9:
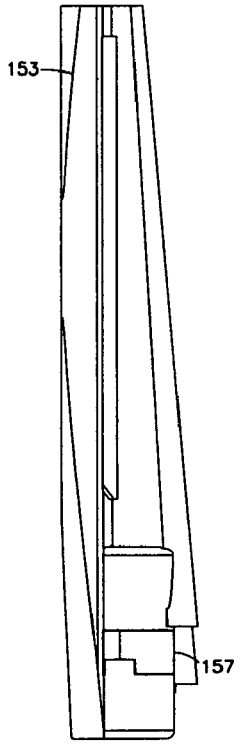
FIG. 9 is a side elevation view of the instrument which corresponds to its underlying tone wheel set seen above in FIG. 8.

FIG. 8 shows a top view of the instrument and its outer structure and surface, where its curvilinear geometry 151 is convenient for the user to utilize this ergonomic configuration for the best results when employing both hands and all fingers due to its ergonomic configuration. This stands efficient due to the movement of both hands along both sides 161 and 159 of the instrument when moving from the top 149 and the bottom 155 when viewing the user in this instance from a frontal point of view. This can also be seen in FIG. 9 where one may move their hand vertically upon the surface 153 down to the where the motor housing is located.

Figure 12:
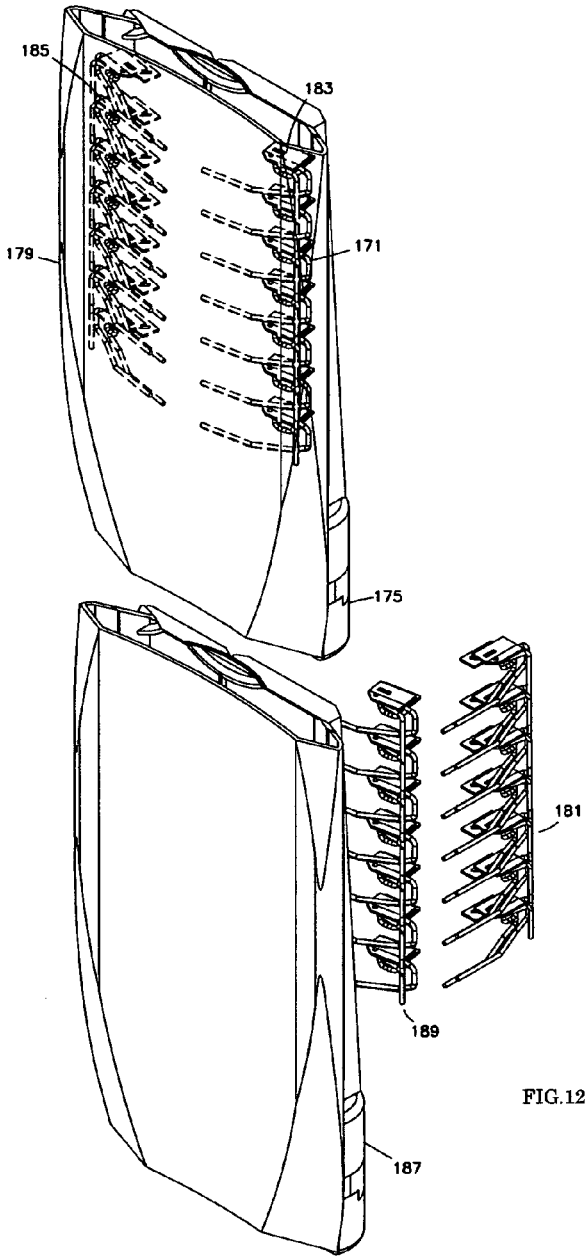
FIG. 12 is an isometric view of the instrument in which the internal/external strut interface is shown hidden inside the instrument with its orientation against the sides and below, the instrument is seen with these struts exterior and in two views outside of the chassis.
Figure 13:
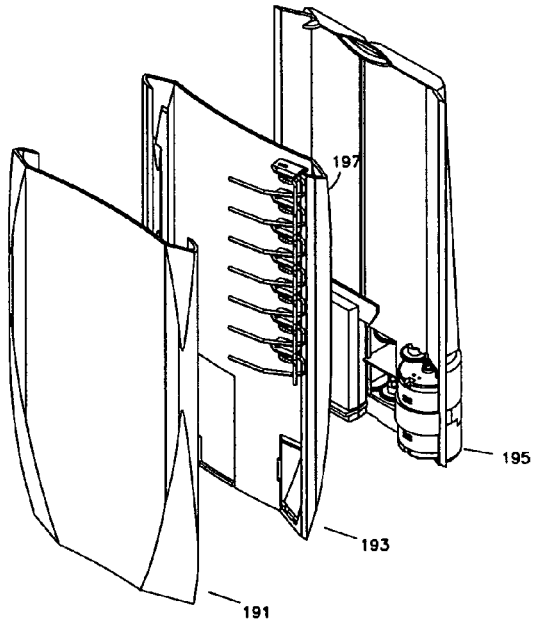
FIG. 13 shows an exploded isometric view of three main shell elements with the multiple strut interfaces.

Similarly, in FIG. 12 the position of the instrument 175 and 187 shows a plausible arrangement of strut mechanisms 189 which ultimately can be activated and manipulated by the outer surfaces 177 and 179 with their corresponding strut assembly 185 and 183. This can be achieved by the user by essentially wrapping ones hand around these two edges 179 and 177 and then utilizing that position to indicate a movement with the inner part of the hand between the thumb and all other fingers. The specific nature and function of these struts which is crucial to the tone generation system will be discussed further through other figures. What is apparent in FIG. 13 as well, is the placement of the strut assembly within the three primary shell support structures of the instrument 191, 193, and 185 for a practical orientation to involve the user from an external source 197 to the physical tone generation and manipulation within the tone wheel/fluid containment system carried internally.

Figure 10:
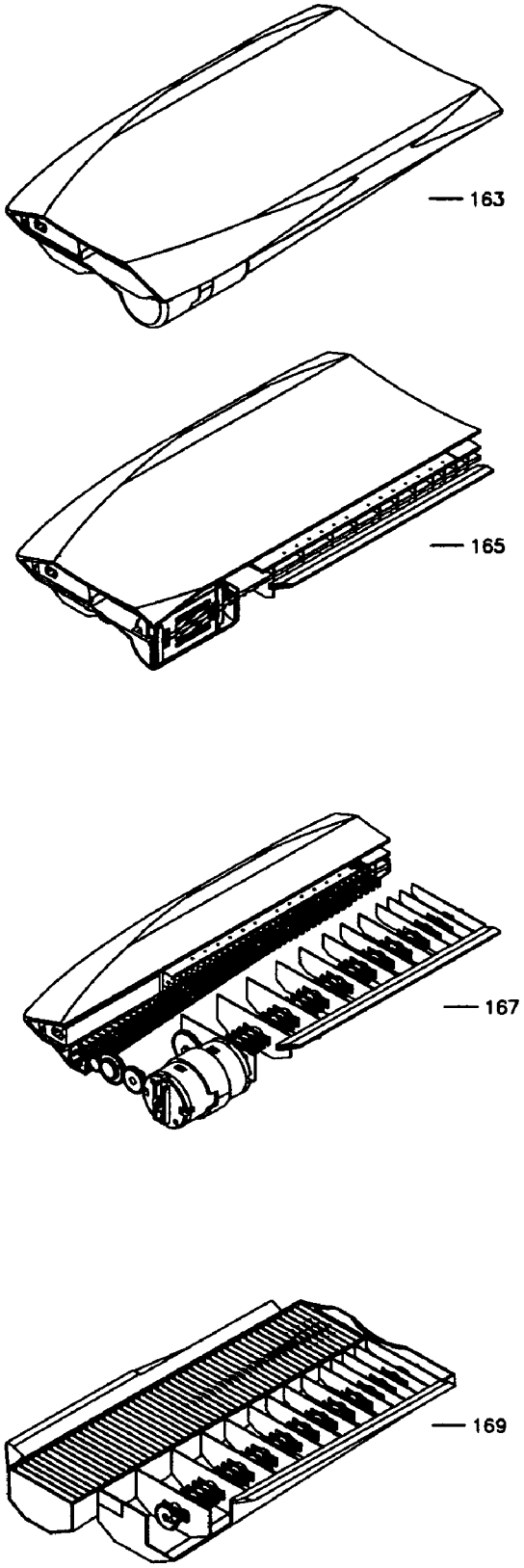
FIG. 10 is a series of isometric drawings illustrating the instrument in almost full assembly with sections.
Figure 11:
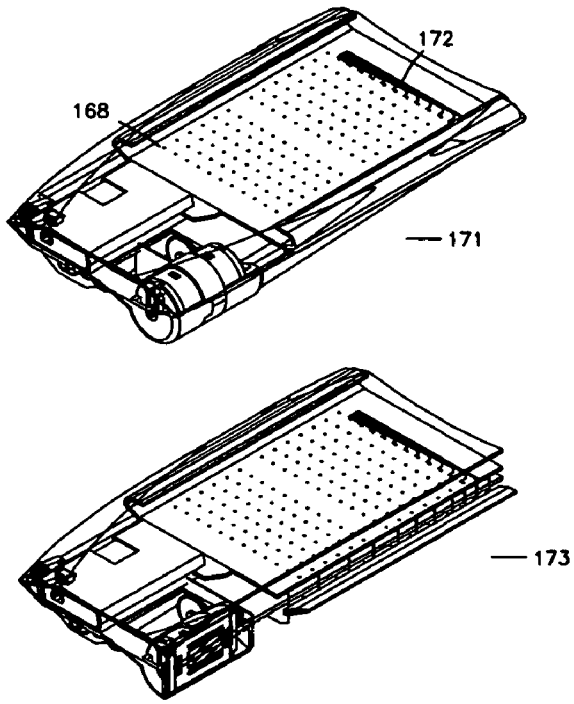
FIG. 11 Shows most of the full assembly of parts with a transparent chassis and surface and again below with a sectional isometric view.

Referring again to FIG. 7, what is important to note is that this arrangement of tone wheels 131 submerged in the series of graduated sub-containment units 121 are not confined to this configuration where the maximization of tone wheels in fluid 123 are shown. A different interval than shown with containment walls 121 with a condensed plurality of wall arrangements is on a broader range 127, which represents approximately half the number of sub-containment walls. In accordance with a further separated configuration of walls, is a longer interval of tone wheels. Ultimately this would decrease the number of possible pitches available to the user, but is plausible in both instances. An additional arrangement is illustrated in FIG. 10 where the fluid housing walls are diminishing in their interval scale, first seen with the instrument sectional isometric view 167 to reveal the wall 166 autonomous as the shaft is extending outward through the bearings. The isometric view of the instruments fluid housing 169 shows the walls 164 engaged with the entirety of the fluid housing 170. In this same figure the instrument in its full assembly 63 is configured along with a section of the instrument 165 simply exhibiting the relatively simple exterior with its internal mechanical qualities where the motor is sectioned as well. Shown in FIG. 11 are the same two views as at the top of FIG. 10, the instrument above and below however have a transparent structure where polycarbonate might be employed with a thin but durable vinyl surface for the user interface. Seen here as well, are the switch holding unit 168 having an array of holes for spring driven post and switches along with one strip of the printed circuit 172 against the switch holding unit.

Figure 7:
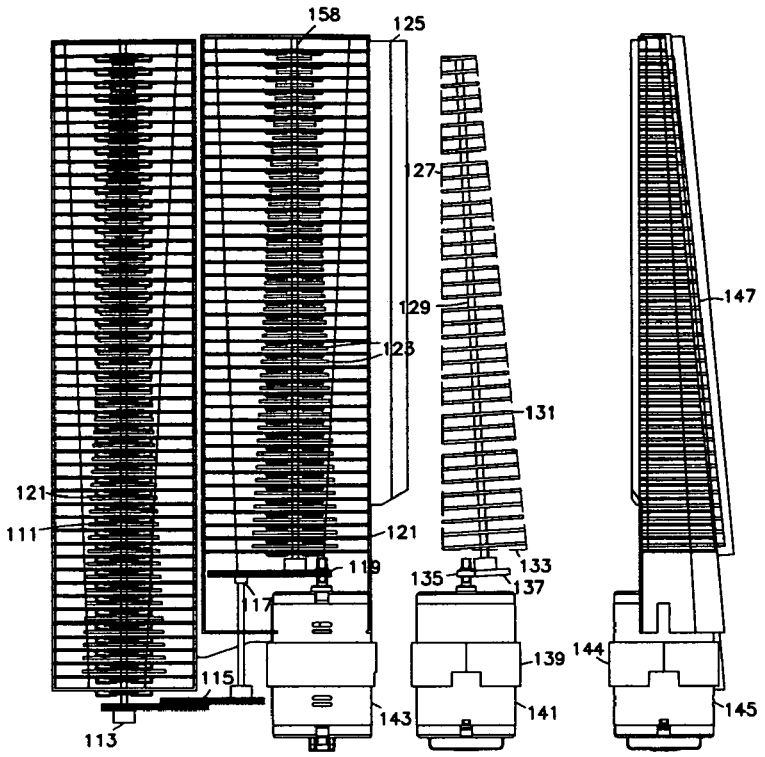
FIG. 7 Shows, from left to right, a top plan view of the tone wheel and fluid container, then a side elevation view of one variation of the tone wheel configuration showing its engagement with an output shaft and motor and then a secondary side elevation drawing of the tone wheel and fluid containment system showing a plausible partition arrangement of sub-containment units.

What is essential in FIG. 7 is that it shows the tone wheel array 133 with its overall body and containment system of fluid. Furthermore, what is also essential from this figure, is that all of the tone wheels 131 are driven by a single servo motor 143, 141, 145, with bearings operatively separating each sub-containment unit and supporting each of two output shafts.

Figure 5:
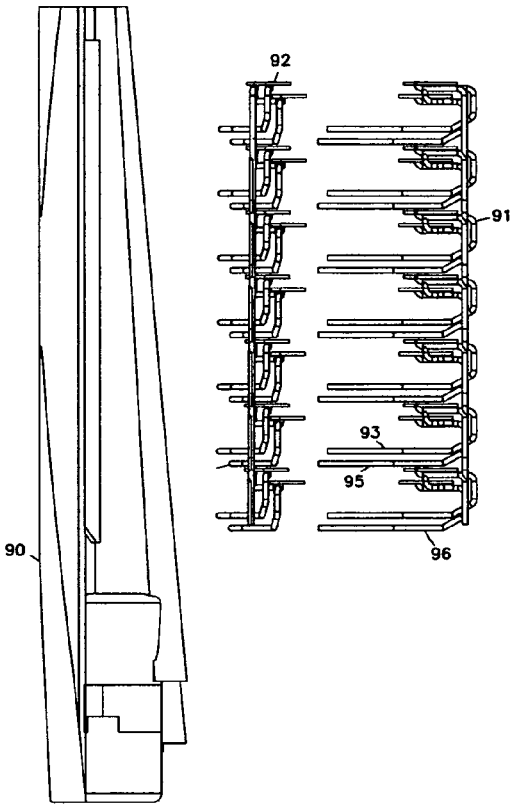
FIG. 5 is a side elevation view of the instrument first with its outer chassis then two elevation views of the strut mechanisms.

In FIG. 5, the strut assembly 92 is shown entirely externalized but aligned with a plausible tone wheel interval configuration from the instrument's outer structure 90, whereby each strut set 93 and 95 is arranged in the same position of each interval of the sub-containment unit in combination with fluid. When this view is rotated ninety degrees the interval arrangement in assembly 96 is apparent.

Figure 6:
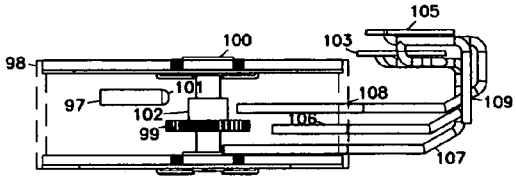
FIG. 6 is top plan view of the tone wheel assembly with its internal/external strut placement and hydrophone/fluid based transducer.

For a more specific understanding of each strut assembly 105, FIG. 6 illustrates a clearer picture of the relationship between the hydrophone or fluid based transducer 97, the tone wheel 102 and the three struts 106, 107, and 109 shown receiving the sound at the tip 101 of the transducer oriented closely to the edge of the tone wheel 99 with its housing walls 98 and 108 where the struts are cantilevered at wall 108.

Figure 14:
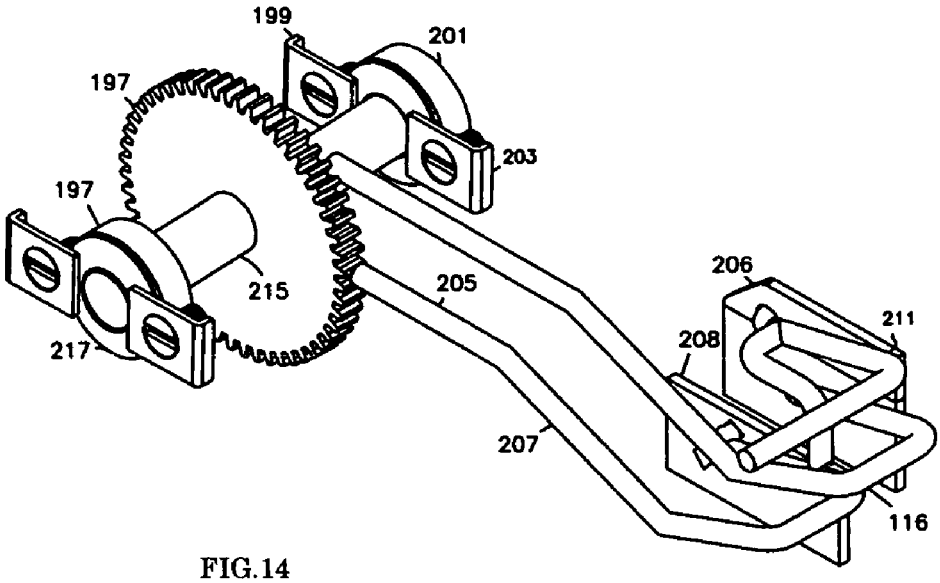
FIG. 14 is an isometric view illustrating the tone wheel and strut assembly autonomous from the containment unit with fluid.
Figure 15:
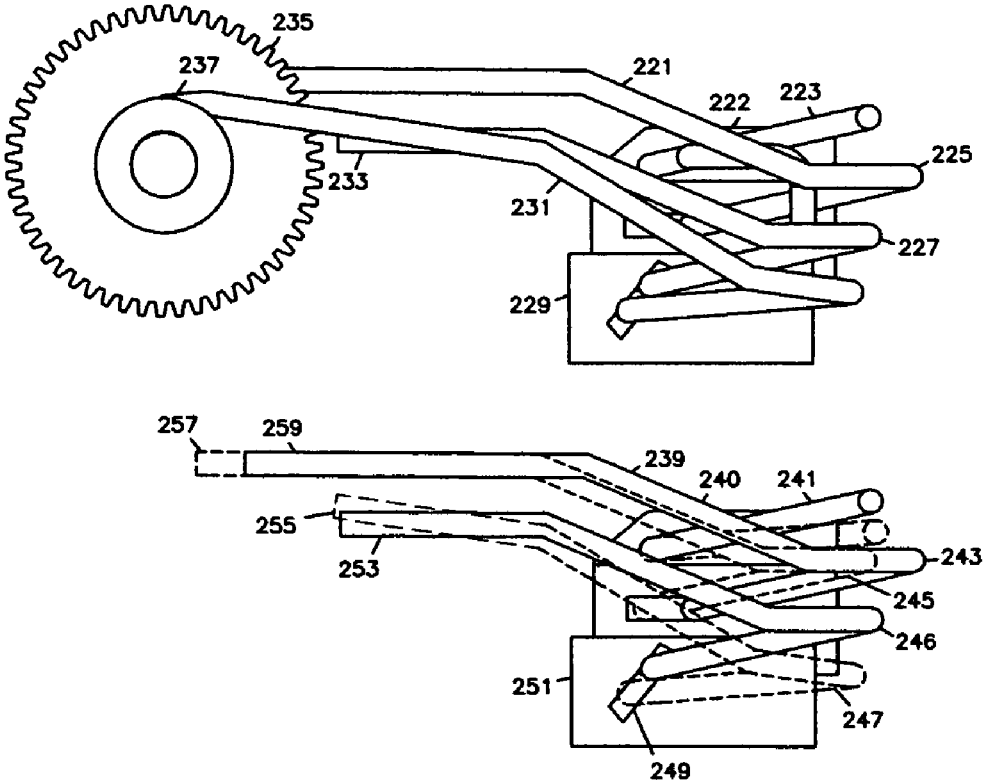
FIG. 15 is a front view of the tone wheel strut assembly along with a front view of the strut assembly illustrating each struts mechanical movement.
Figure 16:
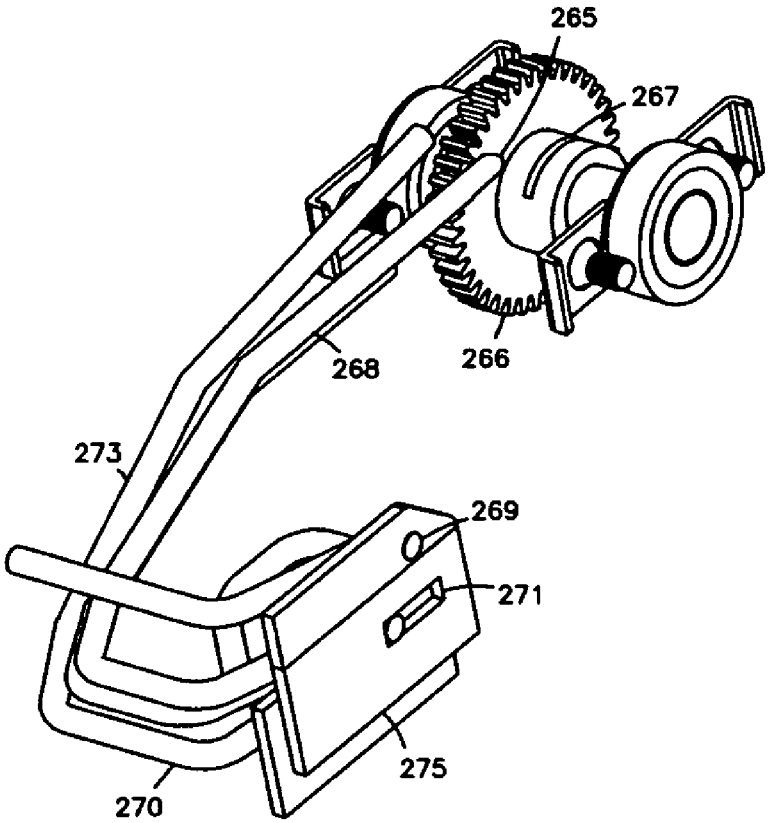
FIG. 16 is a perspective view of the tone wheel where the hub for the struts can be seen with its mechanical features.
Figure 17:
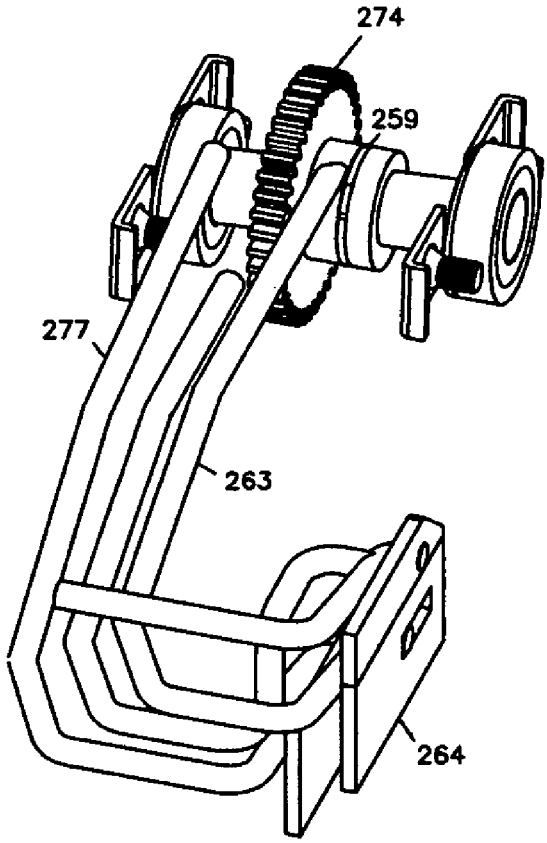
FIG. 17 is a perspective view illustrating the point where one strut engages with the pin release/lock of the tone wheel hub connection to manipulate its level of grip and RPM on the output shaft.

In FIG. 14 the strut assembly is illustrated again showing the three struts 207, 116 and 211, with their respective hubs 206 and 208 for their proper axial and sliding movement support. The shaft 215 which the tone wheel 197 is fixed to, is rotating between the bearing in front 197, and the bearing behind 201 held in place with hardware assembly 199, 203. Thermoplastic bearings are preferable in the instance of submerging the tone wheels within a fluid. In FIG. 15 the side elevation view can be seen of the tone wheel strut assembly where the hubs 229 and 222 for the struts 227, 225 and 223. An important aspect to note in this figure is the grooved elements 235 of the tone wheel. When these are rotating against either fluid/water or the edge 233 of strut 225 a tone is generated. The mechanical movement of strut 225 can be seen below between the struts 246 and 247 with its sliding point 249 from its corresponding hub support 251. This strut 246, because of its orientation at the bottom of the assembly can be seen before in FIG. 12 in its respective position against the side edge 177 of the instruments body. This strut can be moved by grasping it from an exterior position. Similarly, movement between struts 243 and 245 can be seen as well, moving forward into the tone wheel ultimately generating different tonal qualities while increasing the level of friction. It is important to note that the edge of the central strut 227 and its respective edge 233 in its general position and then show below, the movement of that same strut edge 253 to a secondary position 255, is yet another plausible point of friction and placement for a fixed transducer just offset or tangent to the tone wheel and its corresponding grooved elements 235. The strut 223 with its movement seen below 241, is a universal strut which is simply connected to all other struts in the entire tone wheel-strut assembly. When strut 223 is depressed, it universally will activate all other struts in that axis. This provides the user with the ability to change all of the tonal qualities output by the instrument simultaneously.

An additional novel element to the tone wheel is in its ability to decrease in speed and then increase in speed when the pin release mechanism 267 is activated by the movement of strut 268. The view of the hubs axial 269 and sliding 271 support or grooves can be seen more clearly in this figure. A second view of the pin release mechanism 259 can be seen from the tone wheel 274 with it activating strut 263 supported from hub 264 which also again supports additional struts 227 in assembly.

Figure 18:
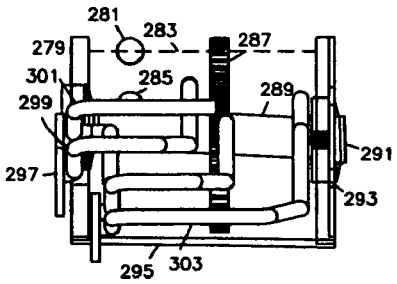
FIG. 18 is a drawing of the side of the fluid housing walls with struts and tone wheel assembly with dual transducers, showing a larger fluid volume capacity and tone wheel dimension.
Figure 19:
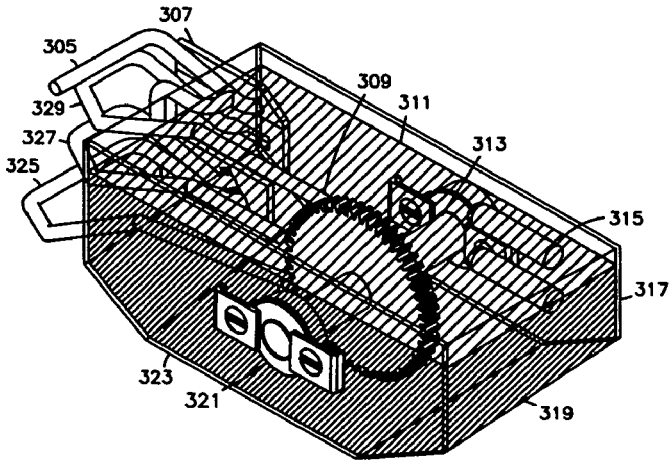
FIG. 19 is a drawing with the same elements as FIG. 18 with a smaller fluid volume capacity and scaled down tone wheel.
Figure 20:
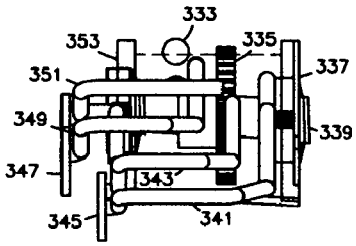
FIG. 20 is a drawing with the same elements as FIG. 19 with further scaled down components.
Figure 21:
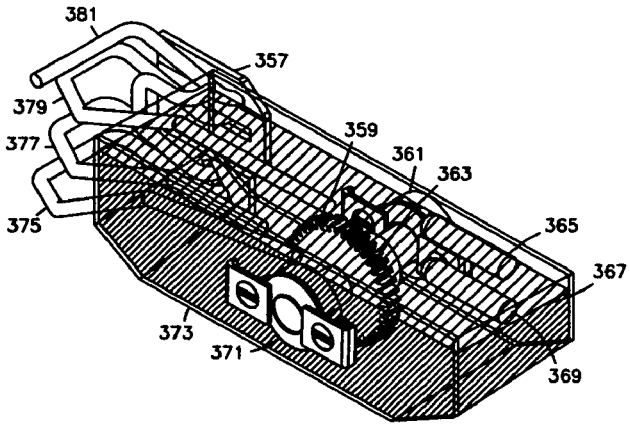
FIG. 21 is an isometric view illustrating the struts cantilevered into the fluid containment unit with a tone wheel and dual transducers also contained within.
Figure 22:
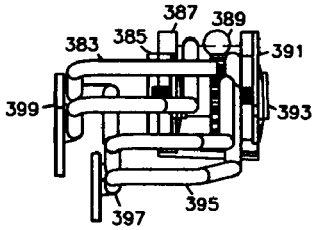
FIG. 22 is an isometric view showing the same elements in FIG. 21 with further scaled down components.
Figure 23:
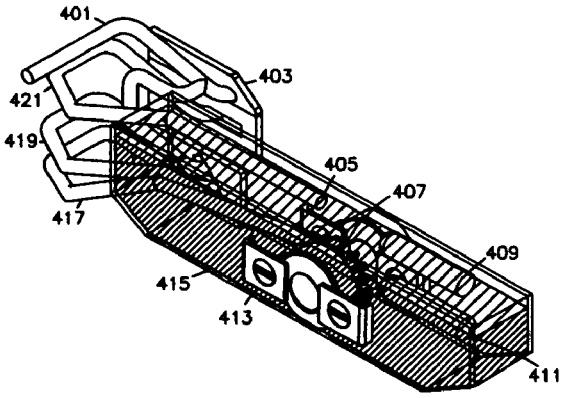
FIG. 23 is an isometric view showing the same elements in FIG. 22 with further scaled down components.

In FIGS. 18, 20, and 22, a secondary side view of the tone wheel strut assembly can be seen in addition to the fluid or more specifically water 283 contained within the housing walls 279 and 293. The shaft 289 driving the tone wheel 287, is supported between bearings 299 and 291. What is essential in these three figures is the placement of the hydrophone or fluid based transducer 281. A secondary fluid based transducer 285 is submerged in the fluid where the transducer 281 above, is partially removed. This in turn generates an output of sound from the tone wheel and its corresponding friction, either to the strut or the fluid itself, which has unique tonal qualities due to the mismatched impedances between fluid in its liquid and gaseous state. In the other figures the hydrophone is partially removed from the fluid in its liquid state. The illustrations in FIGS. 19, 21 and 23, also have the same transducer features with dual transducers 315 and 317, 365 and 369 and 409 and 411 seen in each housing. Struts 305, 329, 325, 381, 379, 377, 375, 401, 421 and 419 are all graduated along with the dimension of each tone wheel 309, 359 and 407 and fluid body 319, 373 and 415 interval. These graduated units show the variation of all of the tone generating elements in assembly which will all change in pitch accordingly.

Figures 24, 25:
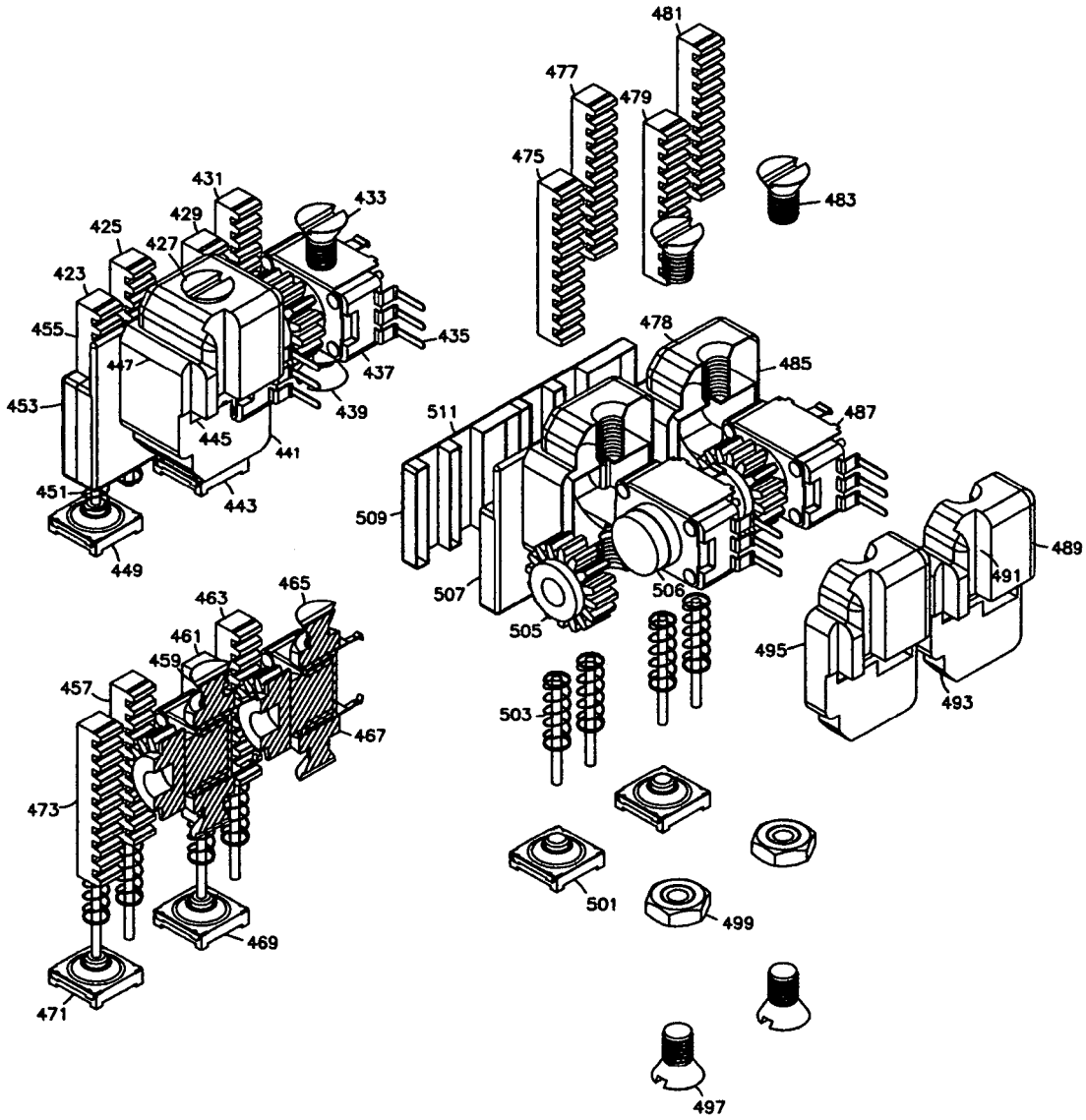
FIG. 24 shows an isometric view above with the orientation of each mechanical spring driven switch shown in its entirety one with a switch holder and one without a switch holder. Below the same elements not including the switch holder are shown in an isometric sectional view.
FIG. 25 is an exploded isometric view of all of the components that make up the mechanical switch assembly
Figure 26:
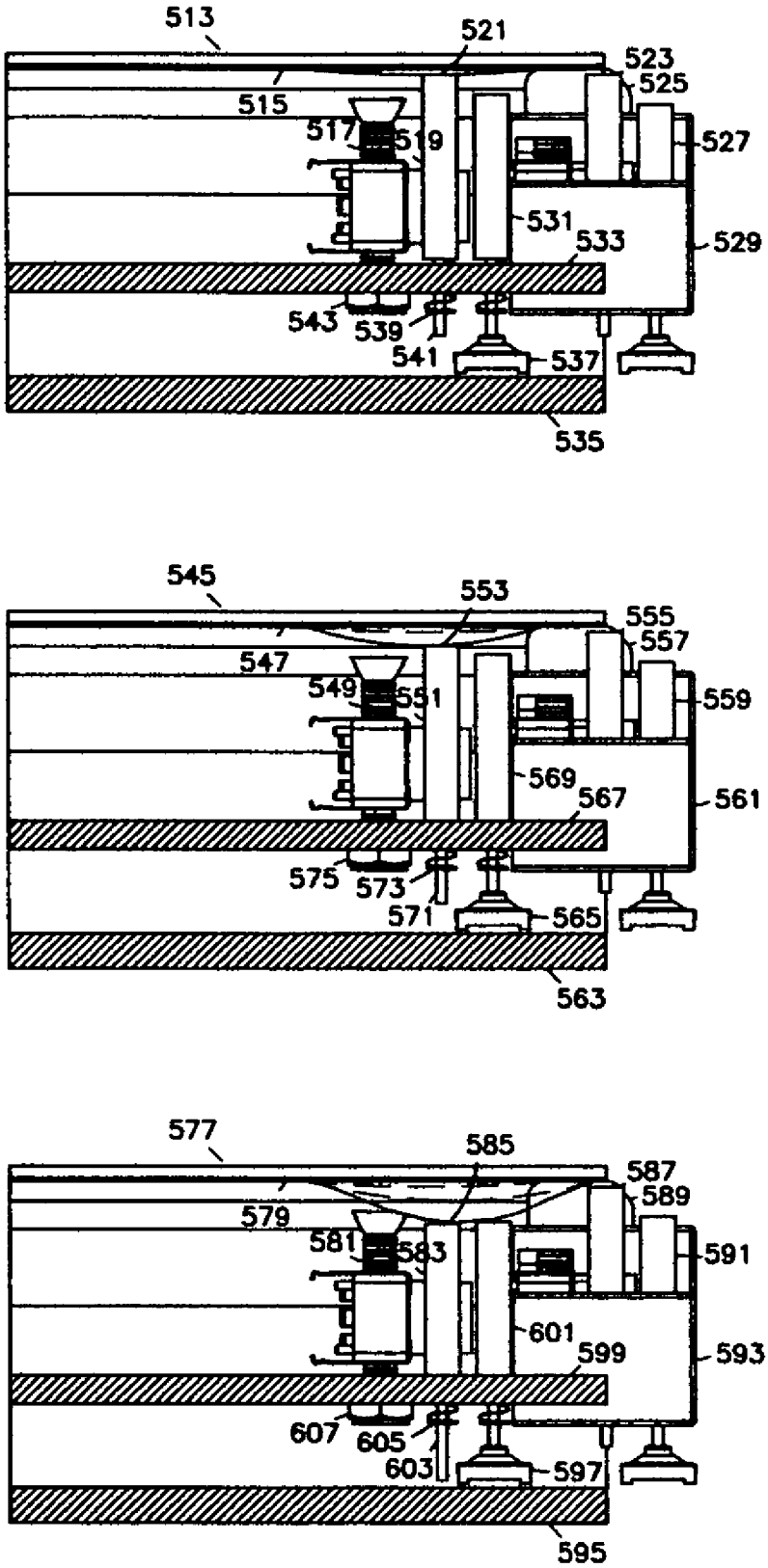
FIG. 26 shows a side sectional view of the mechanical switch in a sequence with three different positions of the depressed malleable surface and its corresponding and underlying switch movement.

Now referring to FIG. 24, an isometric view of the switch holding unit 443 and its position relative to its neighboring switch arrangement 435 without its holding unit is shown. Two racks 455 and 425 are shown indicating one point activating one tone below the malleable surface which rests at the top of the switch holder 427. The first does not necessarily engage itself with the secondary, but is plausible in combination with its attached post and spring 451. This post and spring assembly 451 when depressed at the top 423 of rack 455, the SPST switch below can be activated while rack 425 activates the intensity of the sound. This further provides many different features when one roles ones finger onto and off of the surface. This can be more clearly seen in FIG. 26 where sectional view 513, 545, and 577 can be seen in having its switch chassis 533, 567 and 599 and its switch holder 539, 561 and 593 with the potentiometer exposed 517, 549 and 581, all shown in a fixed position. The elements that do move in this sequence are shown with a possible variation of how one may activate the switch set sounding a tone by depressing the malleable surface 521, 553 and 558 which illustrates both switches 519, 531, 551, 569, 583 and 601 moving at different points. Referring back to FIG. 24, seen below is a sectional isometric view displaying a better view of how the racks 457 and 463 are engaged with the gears which are ultimately attached to the potentiometers. This configuration may also use similar mechanical ideas but in combination with "flex sensors" instead of potentiometers. The exploded view in FIG. 25 simply shows all of the parts 475–511 with two switch assemblies.

Figure 27:
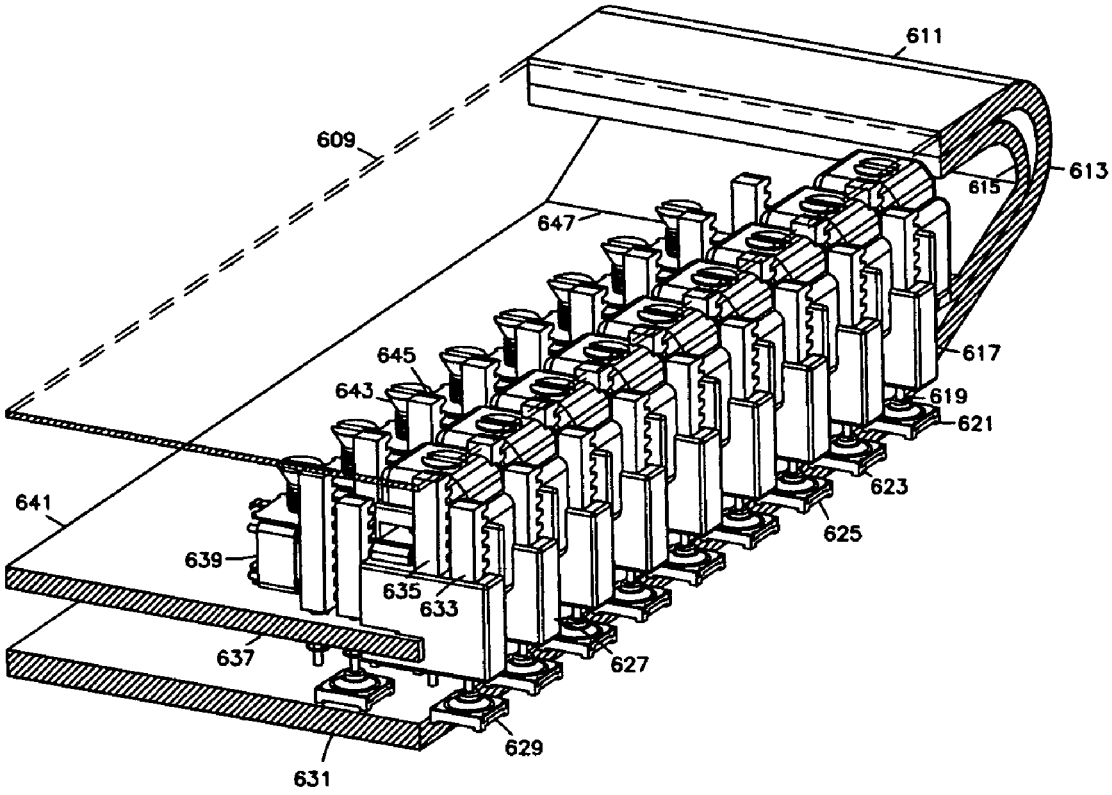
FIG. 27 is a perspective sectional view of an array of the mechanical switches in assembly with the malleable surface above and the switch chassis below.

The previously discussed switch holding unit 637 with its array of switches 643, 629 and 627, oriented within its switch holders 617 and 645, are held within the instrument body 631, 647 and 611, with its malleable surface above 609 which can be seen furthermore in the present FIG. 27.

Figure 28:
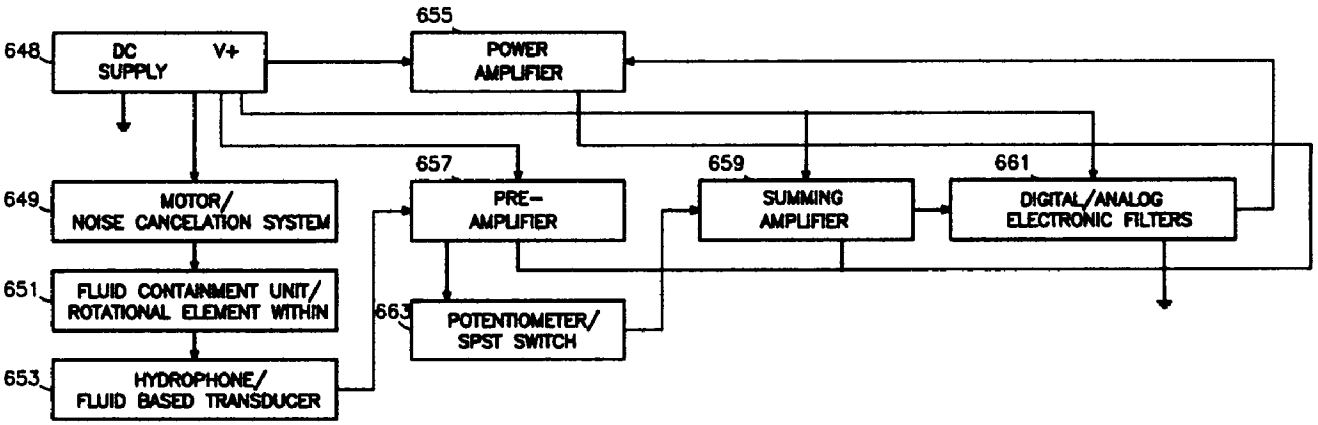
FIG. 28 is an electronic schematic block diagram of the invention with a general description of the flow of current to each major part.

FIG. 28 shows a block diagram which illustrates the essential parts of the instrument that use electronic current with its current flow, which includes the motor 649 pre-amplifier 657, the summing amplifier 659, and the digital/analog electronic filters 661 all of which are powered directly from the power supply 648. The passive systems within the block diagram include the fluid containment unit with a rotational element within 651, the hydrophone or fluid based transducer.

Figure 29:
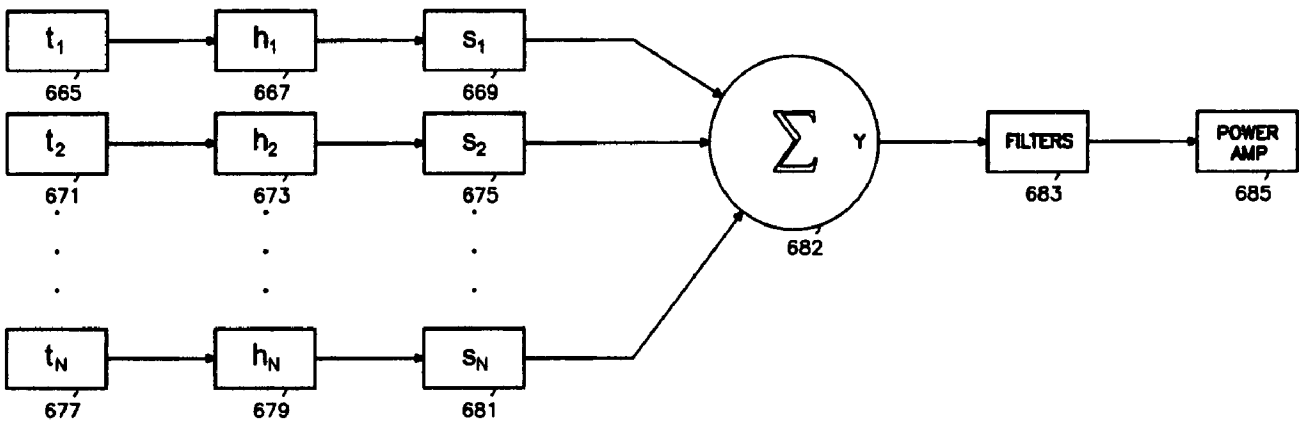
FIG. 29 is a diagram of a more specific description of the components which relate to the summing amplifier.

A more specific diagram illustrating the method employed by the instrument in combination with the summing amplifier is seen in FIG. 29. Each tone wheel, $t_i$, i=(1, 2, . . . , N), 665, 671 and 677 sends an acoustical signal to hydrophone, $h_i$, which is a transducer followed by a pre-amp. The signal from the ith hydrophone, $h_i$, 667, 673 and 679, travels to an analog SPST switch with potentiometer, $s_i$, 669, 675 and 681, which is directly controlled by the user and is arranged such that N signals passing through are summed producing signal Y 682, before entering filter modules 683 and then output to be amplified by the power amplifier 685.

Figure 30:
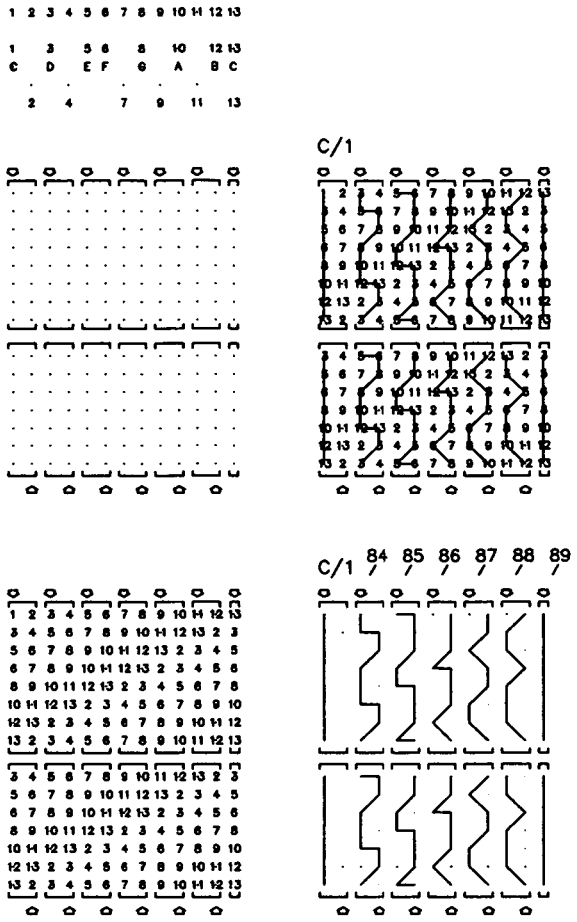
FIG. 30 shows a further enlarged view of FIG. 4 as a reference to the instrument

FIG. 30 shows a further enlarged view of FIG. 4 as a reference to the instrument.

Figure 31:
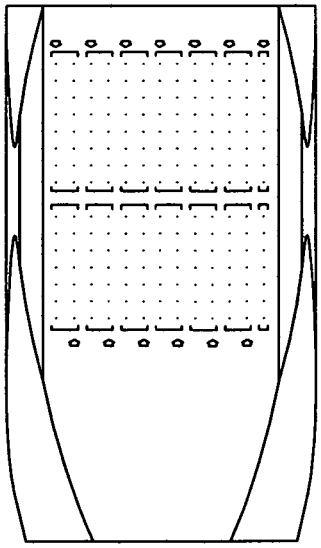
FIG. 31 is a plan view of the instrument with the array of points oriented on top of the malleable surface of the instrument in accordance with the user interface seen also in plan view in FIG. 8 and also corresponding to FIG. 30.

FIG. 31 is a plan view of the instrument with the array of points oriented on top of the malleable surface of the instrument in accordance with the user interface seen also in plan view in FIG. 8 and also corresponding to FIG. 30.

Figure 32:
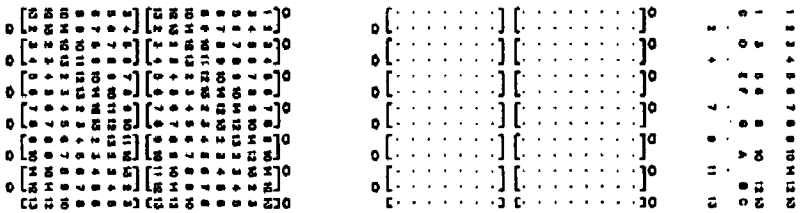
Figure 33:
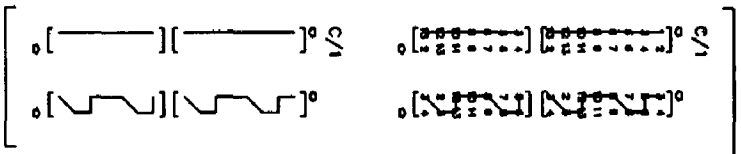
Figure 34:
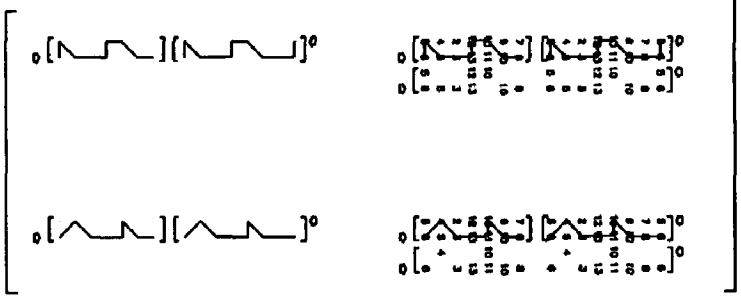
Figure 35:
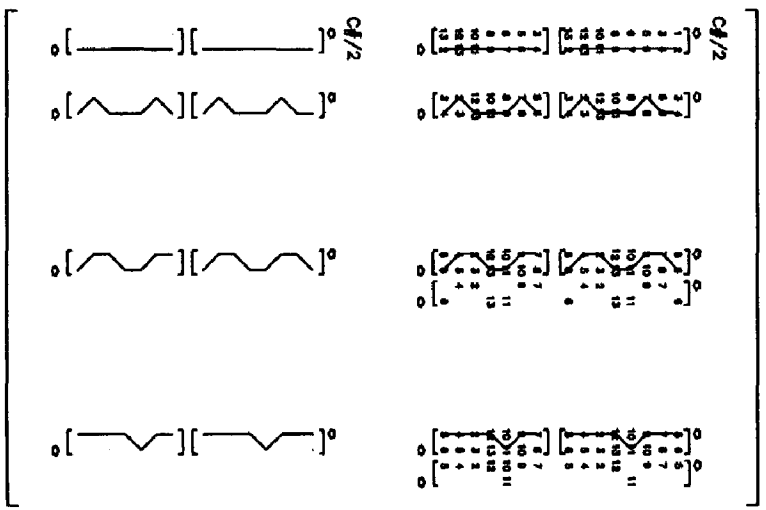

FIG. 32 shows a plan view of the point system and its corresponding numbers as a reference to the following FIGS. 33–35.

FIG. 33 is a diagram of the first two "C" scale geometry sets and how they are derived from the arrangement of points and their corresponding numbers along with the geometry extracted below.

FIG. 34 is a diagram of the third and the fourth set of the "C" scale with its corresponding numbers to the right and its relative geometry extracted below in accordance with each set shown.

FIG. 35 is a diagram of the "C#" scale sets with the same sequence and description as in FIGS. 33 and 34.

Figure 36:
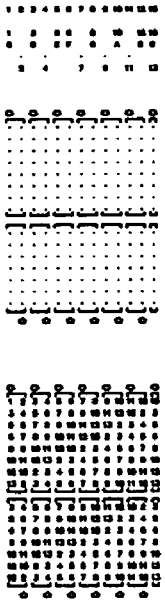
Figure 37:
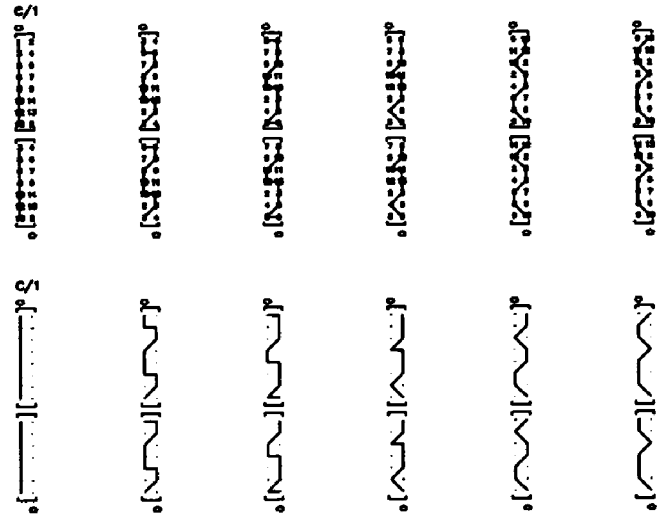
Figure 38:
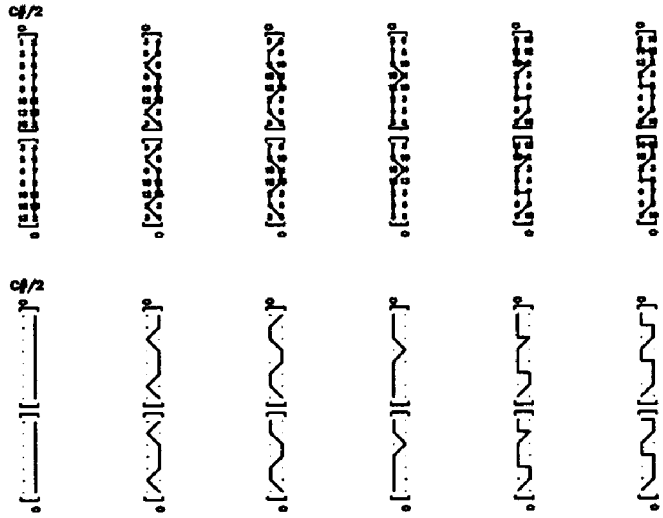
Figure 39:
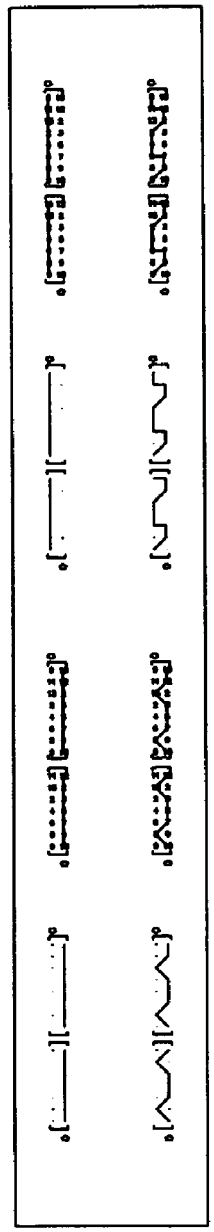

FIG. 36 is a diagram of the plan of points with its corresponding numbers as a reference to the following FIGS. 37–39.

FIG. 37 is a diagram of all six sets of scales for the key of "C."

FIG. 38 is a diagram of all six sets of scales for the key of "C#."

FIG. 39 is a diagram of the first two sets of the "C" and "C#" scales as a reference to the previous FIGS. 37–38.

Figure 40:
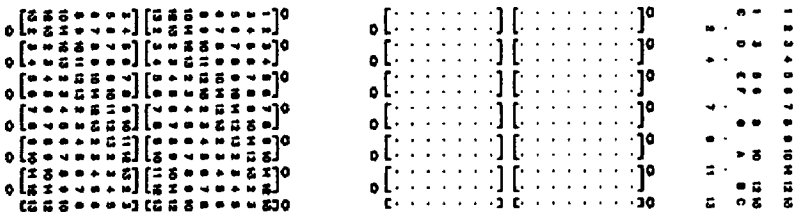
Figure 41:
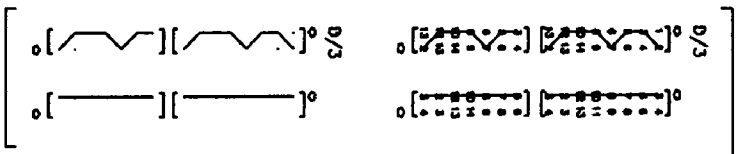
Figure 42:
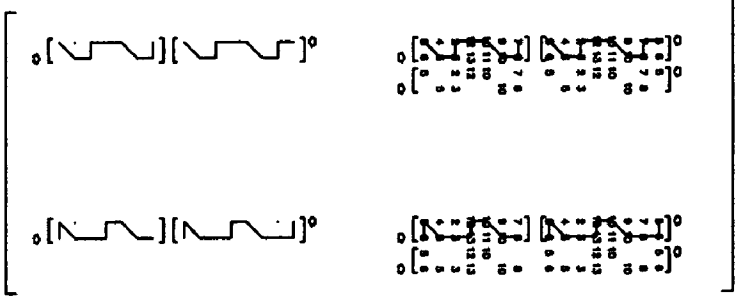
Figure 43:
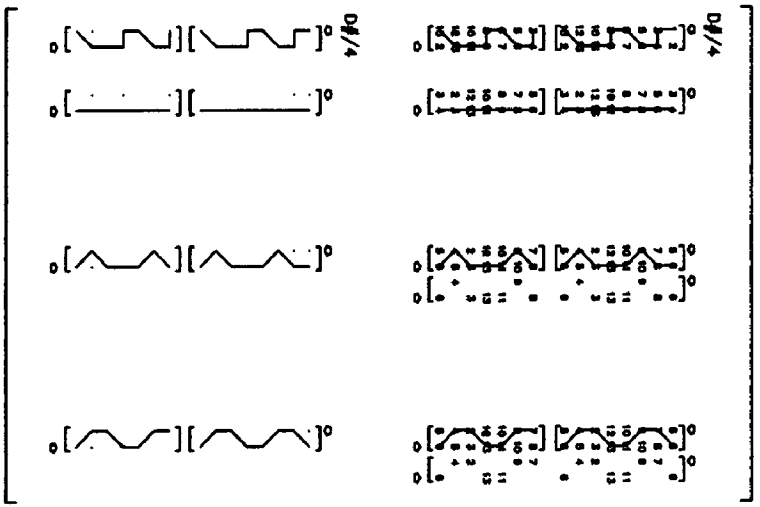

FIG. 40 shows a plan view of the point system and its corresponding numbers as a reference to the following FIGS. 41–43.

FIG. 41 is a diagram of the first two "D" scale geometry sets and how they are derived from the arrangement of points and their corresponding numbers along with the geometry extracted below.

FIG. 42 is a diagram of the third and the fourth set of the "D" scale with its corresponding numbers to the right and its relative geometry extracted below in accordance with each set shown.

FIG. 43 is a diagram of the "D#" scale sets with the same sequence and description as in FIGS. 41 and 42.

Figure 44:
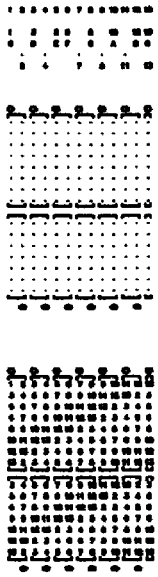
Figure 45:
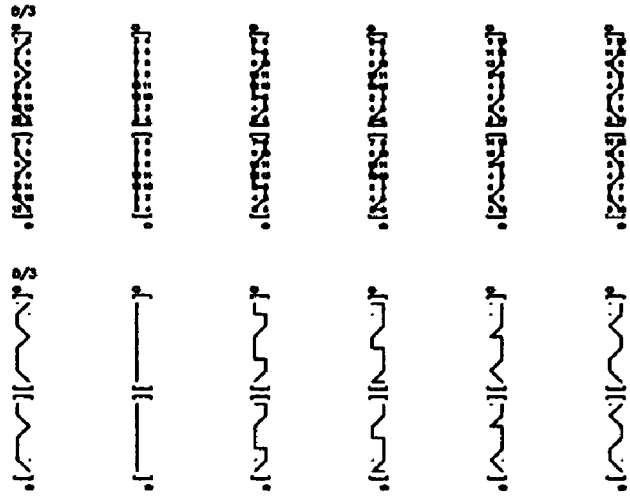
Figure 46:
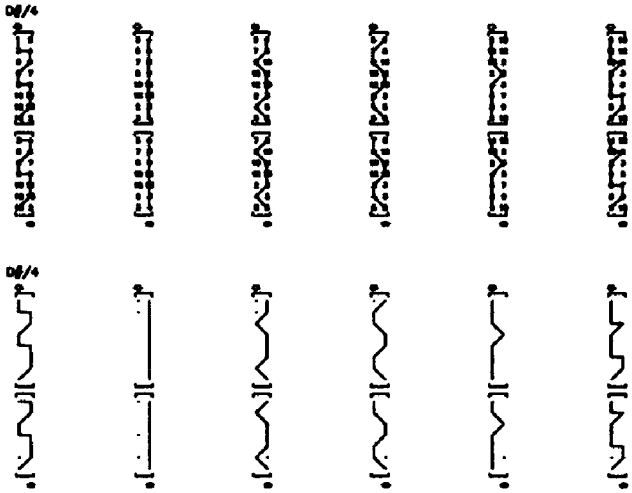
Figure 47:
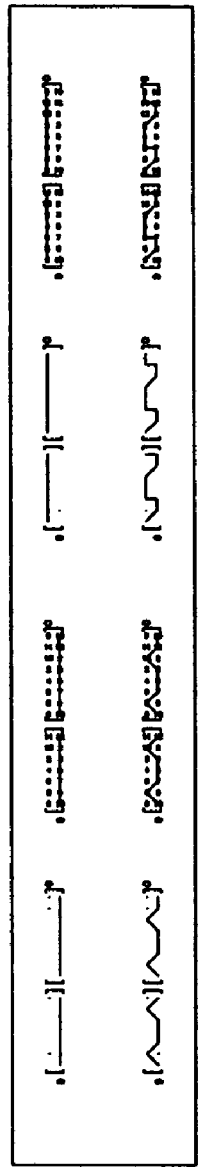

FIG. 44 is a diagram of the plan of points with its corresponding numbers as a reference to the following FIGS. 45–47.

FIG. 45 is a diagram of all six sets of scales for the key of "D."

FIG. 46 is a diagram of all six sets of scales for the key of "D#."

FIG. 47 is a diagram of the first two sets of the "C" and "C#" scales as a reference to the previous FIGS. 45–46.

FIG. 48 shows a plan view of the point system and its corresponding numbers as a reference to the following FIGS. 49–51.

FIG. 49 is a diagram of the first two "E" scale geometry sets and how they are derived from the arrangement of points and their corresponding numbers along with the geometry extracted below.

FIG. 50 is a diagram of the third and the fourth set of the "E" scale with its corresponding numbers to the right and its relative geometry extracted below in accordance with each set shown.

FIG. 51 is a diagram of the "F" scale sets with the same sequence and description as in FIGS. 49 and 50.

Figure 52:
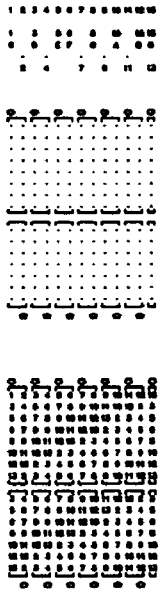
Figure 53:
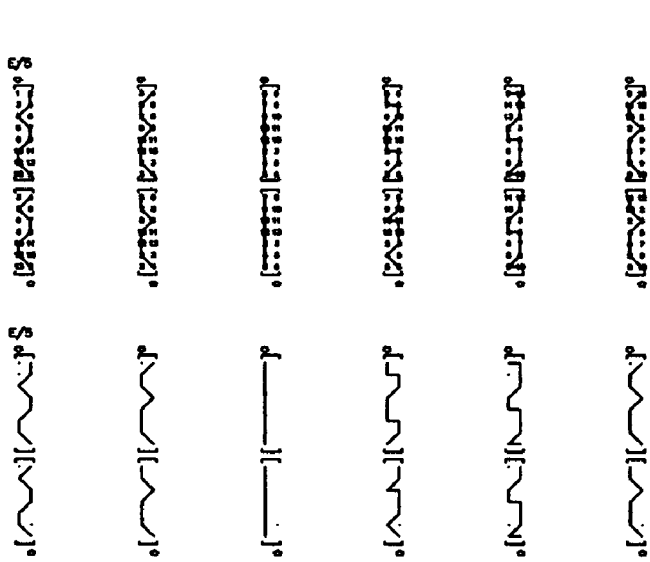
Figure 54:
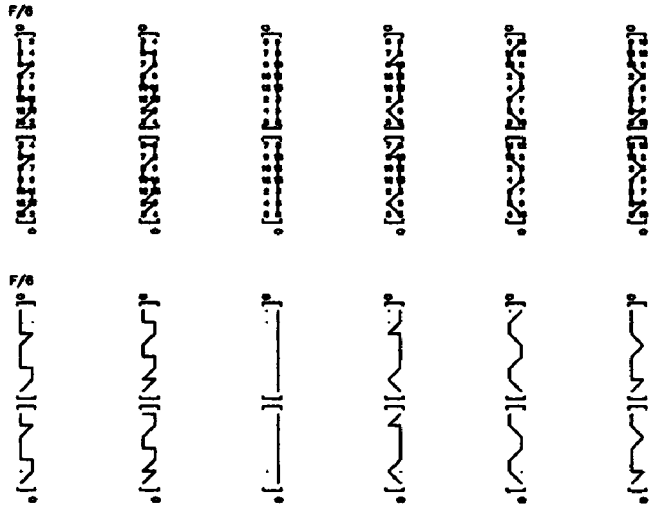
Figure 55:
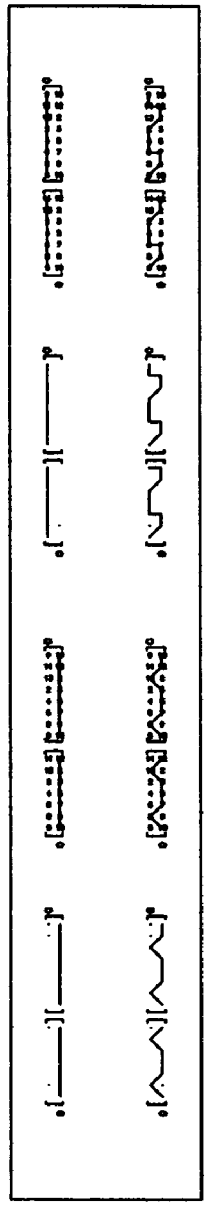

FIG. 52 is a diagram of the plan of points with its corresponding numbers as a reference to the following FIGS. 53–55.

FIG. 53 is a diagram of all six sets of scales for key of "E."

FIG. 54 is a diagram of all six sets of scales for the key of "F."

FIG. 55 is a diagram of the first two sets of the "C" and "C#" scales as a reference to the previous FIGS. 53–54.

Figure 56:
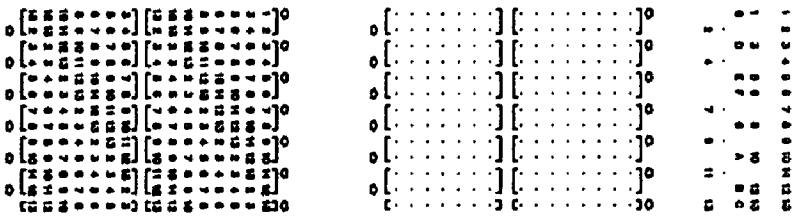
Figure 57:
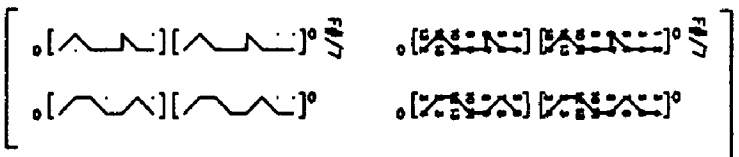
Figure 58:
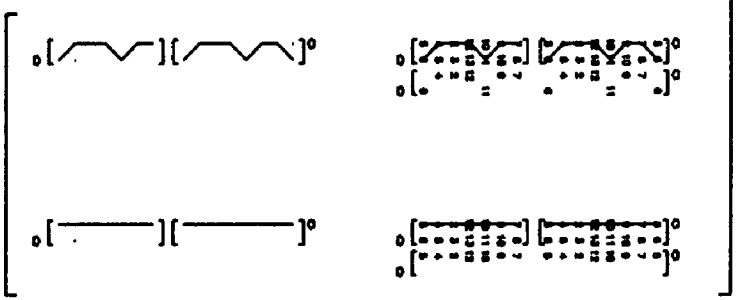
Figure 59:
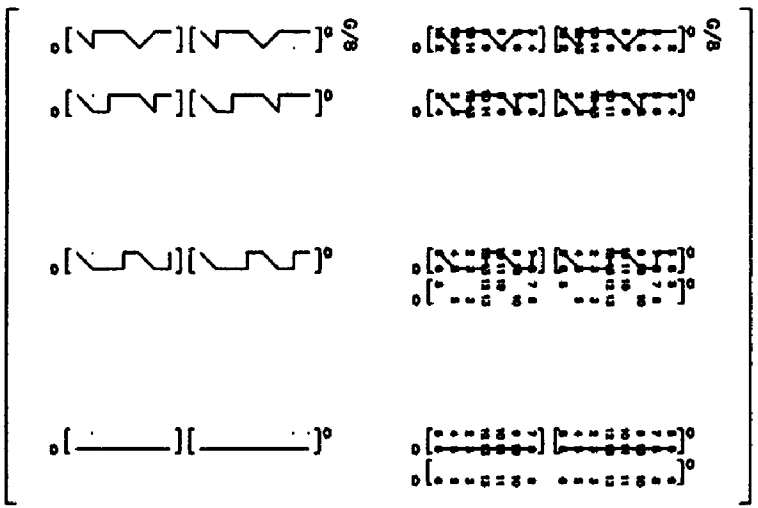

FIG. 56 shows a plan view of the point system and its corresponding numbers as a reference to the following FIGS. 57–59.

FIG. 57 is a diagram of the first two "F#" scale geometry sets and how they are derived from the arrangement of points and their corresponding numbers along with the geometry extracted below.

FIG. 58 is a diagram of the third and the fourth set of the "F#" scale with its corresponding numbers to the right and its relative geometry extracted below in accordance with each set shown.

FIG. 59 is a diagram of the "G" scale sets with the same sequence and description as in FIGS. 57 and 58.

Figure 60:
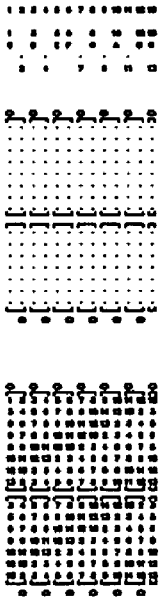

FIG. 60 is a diagram of the plan of points with its corresponding numbers as a reference to the following FIGS. 61–64.

Figure 61:
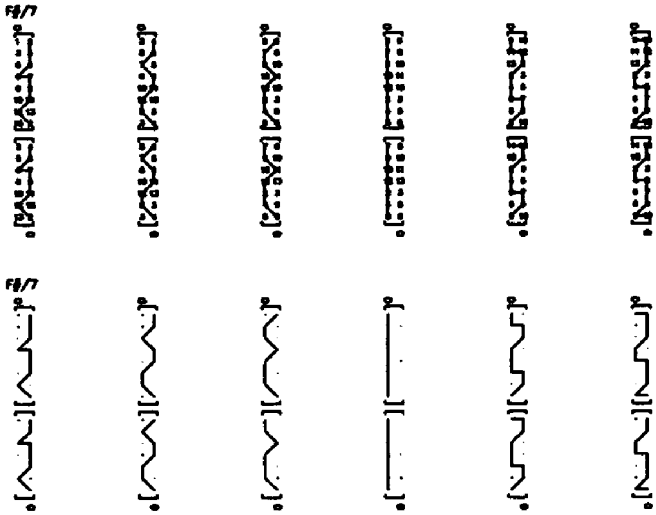

FIG. 61 is a diagram of all six sets of scales for the key of "F#."

Figure 62:
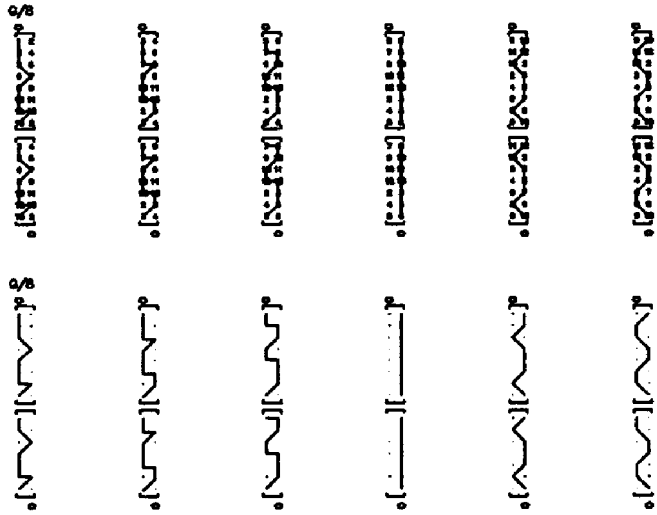

FIG. 62 is a diagram of all six sets of scales for the key of "G."

Figure 63:
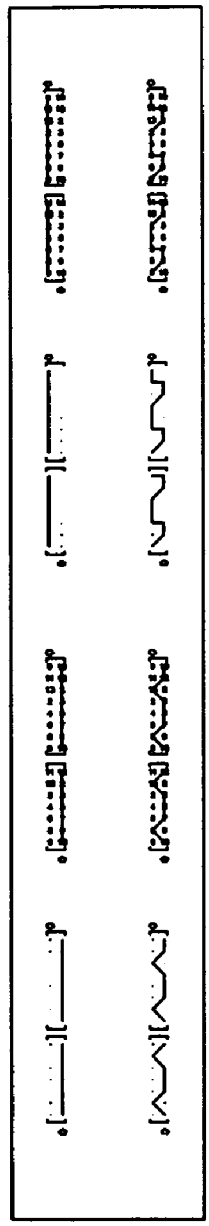

FIG. 63 is a diagram of the first two sets of the "C" and "C#" scales as a reference to the previous FIGS. 61–62.

Figure 64:
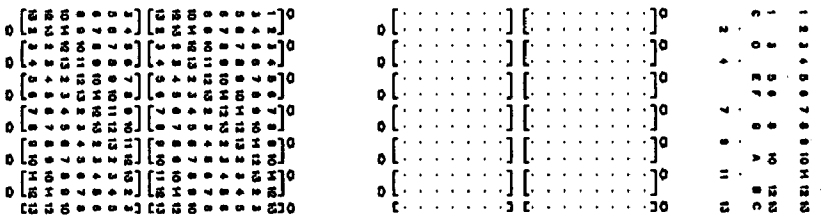
Figure 65:
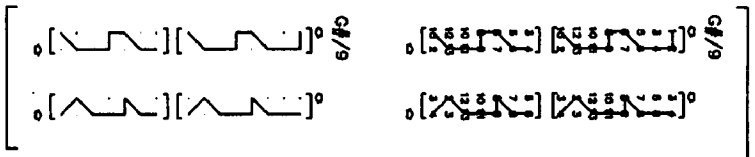
Figure 66:
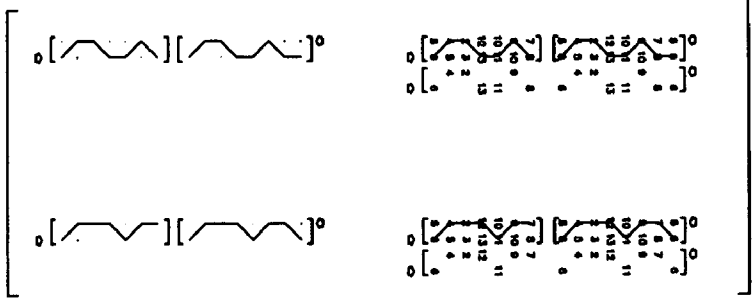
Figure 67:
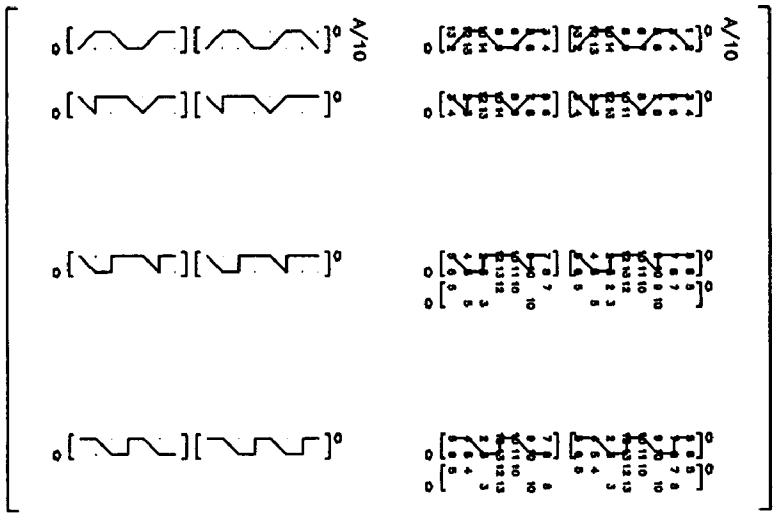

FIG. 64 shows a plan view of the point system and its corresponding numbers as a reference to the following FIGS. 65–67.

FIG. 65 is a diagram of the first two "G#" scale geometry sets and how they are derived from the arrangement of points and their corresponding numbers along with the geometry extracted below.

FIG. 66 is a diagram of the third and the fourth set of the "G#" scale with its corresponding numbers to the right and its relative geometry extracted below in accordance with each set shown.

FIG. 67 is a diagram of the "A" scale sets with the same sequence and description as in FIGS. 65 and 66.

Figure 68:
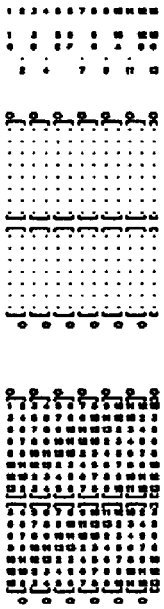
Figure 69:
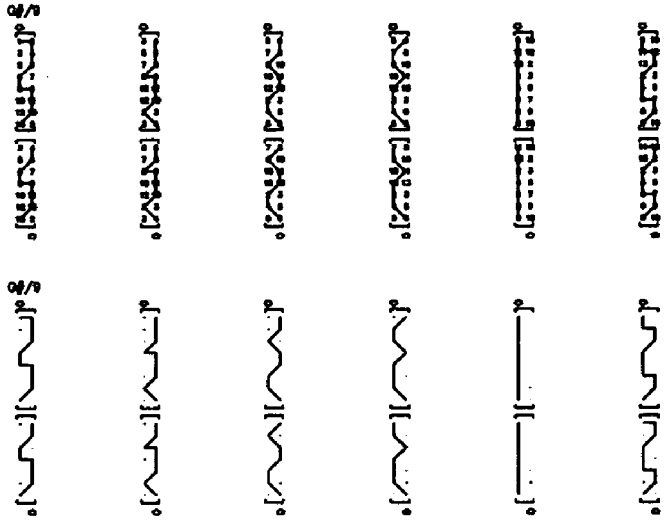
Figure 70:
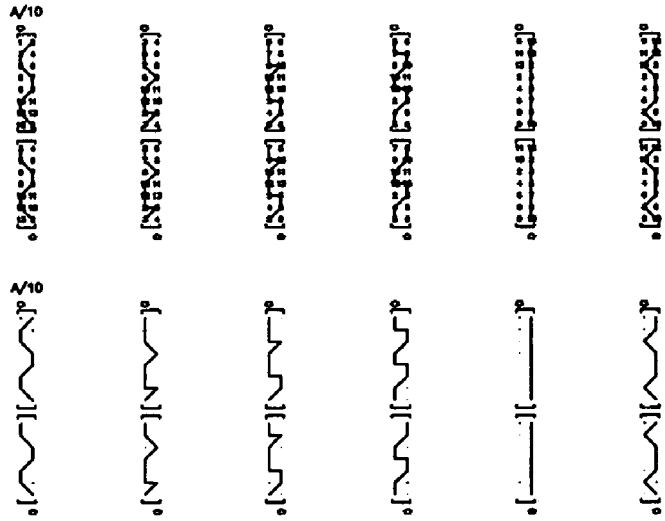
Figure 71:
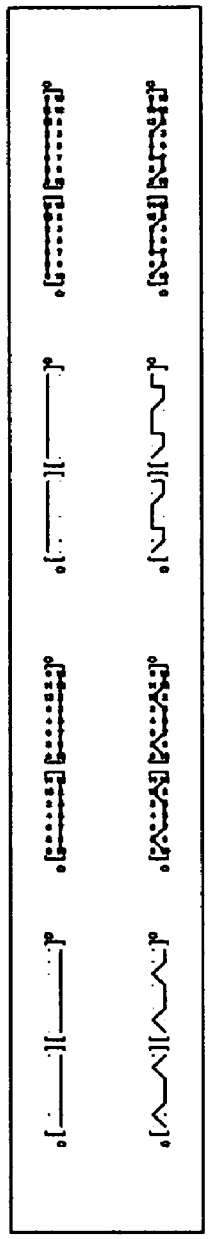

FIG. 68 is a diagram of the plan of points with its corresponding numbers as a reference to the following FIGS. 69–71.

FIG. 69 is a diagram of all six sets of scales for the key of "G#."

FIG. 70 is a diagram of all six sets of scales for the key of "A."

FIG. 71 is a diagram of the first two sets of the "C" and "C#" scales as a reference to the previous FIGS. 69–70.

FIG. 72 shows a plan view of the point system and its corresponding numbers as a reference to the following FIGS. 73–75.

FIG. 73 is a diagram of the first two "A#" scale geometry sets and how they are derived from the arrangement of points and their corresponding numbers along with the geometry extracted below.

FIG. 74 is a diagram of the third and the fourth set of the "A#" scale with its corresponding numbers to the right and its relative geometry extracted below in accordance with each set shown.

FIG. 75 is a diagram of the "B" scale sets with the same sequence and description as in FIGS. 73 and 74.

Figure 76:
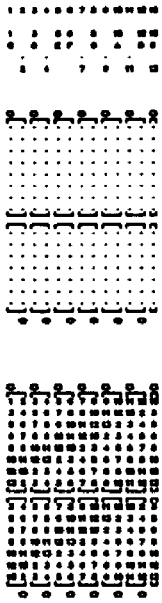
Figure 78:
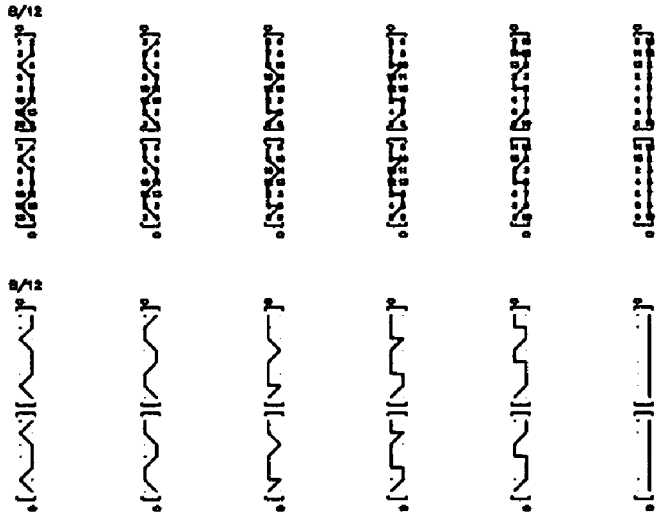

FIG. 76 is a diagram of the plan of points with its corresponding numbers as a reference to the following FIGS. 77–79.

FIG. 77 is a diagram of all six sets of scales for the key of "A#."

FIG. 78 is a diagram of all six sets of scales for the key of "B."

FIG. 79 is a diagram of the first two sets of the "C" and "C#" scales as a reference to the previous FIGS. 77–78.

Although the present invention has been described with reference to specific details, it is not intended that such details should be regarded as limitations upon the scope of the invention, except as and to the extent that they are included in the accompanying claims.

What is claimed is:

1. A polyphonic instrument comprising:

a housing containing a body of fluids for said polyphonic instrument, such that said fluid body is in a liquid state;

a plurality of tone wheels disposed in said fluid body, such that a series of said tone wheels disposed in said fluid body are arranged in graduated units;

a series of struts cantilevered from a side wall of said housing corresponding in quantity to said tone wheels disposed in said fluid body;

a motor coupled with an output shaft for driving said tone wheels disposed in said fluid body;

an array of transducers disposed within the housing;

an audio amplifier system outside the housing and operatively connected to said transducers;

whereby when the motor activates the tone wheels, the friction level between the tone wheels and the fluid body generates a sound which is detected by the transducer and then output to an audio amplifier system.

2. The polyphonic instrument as in claim 1, further includes a combination of said fluid body with a secondary fluid body in a gaseous state.

3. The polyphonic instrument as in claim 2, wherein a portion of said transducer are positioned both partially internal to said fluid body and partially internal to said secondary fluid body in a gaseous state, further providing sound received with mismatched impedances, creating additional tonal quality when said tone wheel is generating tone.

4. The polyphonic instrument as in claim 3, wherein each of said tone wheels further includes a radial array of grooved and protruding elements such that said radial array of grooved and protruding elements change in number to that of said graduated units of said tone wheels.

5. The polyphonic instrument as in claim 4, wherein said tone wheels are rotating tangent to the edge of said struts, a tone is generated based upon the friction between elements.

6. The polyphonic instrument as in claim 5, further including hub elements for providing support and axial and sliding mechanical motion for each of said struts, such that can be manipulated within said fluid body from an external point.

7. The polyphonic instrument as in claim 6, wherein said struts when mechanically manipulated by said external movement further provide a change in the qualities of said tone given off due to said friction between both elements.

8. The polyphonic instrument as in claim 6, wherein said struts have transducers attached to each strut edge thereof for creating friction between said strut edge, said transducers and said tone wheels.

9. The polyphonic instrument as in claim 6, wherein said struts have a specific protruding edge for activating said pin release mechanisms which correspond to each of said tone wheels.

10. The polyphonic instrument as in claim 8, further includes that said pin release mechanisms when released activate two essential states; diminishing the RPM of said tone wheel and accelerating the RPM of said tone wheel generating additional tonal qualities.

11. A polyphonic instrument comprising:

a user interface oriented in accordance with an array of points that corresponds with an array of tones;

a set of spring driven switches oriented upon said array of points;

a malleable surface oriented above said spring driven switches separated across a flat two-dimensional plane within a switch holding chassis;

a series of individual switch holders defining the said spring driven switches' orientation and separation for preventing interference between other notes located within said switch holding chassis and below said malleable surface;

whereby when the said malleable surface is depressed at each of the given nodes across said of points, its respective tone is activated having a number of physical interface qualities which correspond directly to the output of its tonal qualities.

12. The polyphonic instrument as in claim 11, wherein said spring driven switches are oriented such that they are activated by two points within each point given across said array of points and said malleable surface.

13. The polyphonic instrument defined by claim 12, further provides a switch system that indicates the intensity of the tone at one of the said two points within the said node and a second point of said two points toggles the respective tone on or off.

14. The polyphonic instrument defined by claim 13, further includes that each said two points within each said node are coupled with a potentiometer attached to a spur gear with a rack indicating the intensity of the tone through a downward movement against the rack and a downward movement from a second rack activating the SPST switch to turn the tone on or off.

15. The polyphonic instrument defined by claim 13, further provides a switch system that indicates the said intensity of the tone at one of the said two points within the said node and a second point of said two points toggles the respective tone on or off utilizing flex sensors.

16. The polyphonic instrument comprising:

a geometric arrangement derived from one hundred and ninety five points across two separate grids each consisting of thirteen points running vertically across the Y-Axis and two of X-Axis coordinates running horizontally separated into a set of eight points above and seven points below which corresponds to the twelve tone system of music;

whereby the top said thirteen points are based upon the notes of an octave, C, C#, D, D#E, F, F#, G, G#, A, A#, B, C and each point oriented vertically along the Y-axis is base upon the intervals of a major scale and all of the points that are oriented along the x-axis for each horizontal set are oriented sequentially in regular intervals in accordance with said twelve tones.

17. The polyphonic instrument as in claim 12, wherein said geometric arrangement includes each of the separated scales of the twelve tone system of music when its particular geometric is derived from said points, which ultimately follows a series of geometric patterns to be employed with a user interface.

* * * * *